US008238563B2

(12) United States Patent
Rumsey et al.

(10) Patent No.: US 8,238,563 B2
(45) **Date of Patent: *Aug. 7, 2012**

(54) SYSTEM, DEVICES AND METHODS FOR PREDICTING THE PERCEIVED SPATIAL QUALITY OF SOUND PROCESSING AND REPRODUCING EQUIPMENT

(75) Inventors: Francis Rumsey, Guildford (GB); Slawomir Zielinski, Guildford (GB); Philip Jackson, Guildford (GB); Martin Dewhirst, Stewkley (GB); Robert Conetta, Gravesend (GB); Sunish George, Kerala (IN); Søren Bech, Holstebro (DK); David Meares, Horsham (GB); Benjamin Supper, Pinner (GB)

(73) Assignee: University of Surrey-H4, Surrey (GB)

( * ) Notice: Subject to any disclaimer, the term of this patent is extended or adjusted under 35 U.S.C. 154(b) by 1148 days.

This patent is subject to a terminal disclaimer.

(21) Appl. No.: 12/051,912

(22) Filed: Mar. 20, 2008

(65) Prior Publication Data

US 2009/0238370 A1 Sep. 24, 2009

(51) Int. Cl.
*H04R 29/00* (2006.01)

(52) U.S. Cl. ..... 381/56; 381/58; 381/59; 381/96; 381/98; 381/101; 381/102; 381/103

(58) Field of Classification Search ..... 381/56, 381/58, 59, 96, 98, 101, 102, 103
See application file for complete search history.

(56) References Cited

U.S. PATENT DOCUMENTS

| | | | | |
|---|---|---|---|---|
| 7,386,133 | B2 | 6/2008 | Hess et al. | |
| 2008/0260166 | A1 | 10/2008 | Hess | |
| 2009/0171671 | A1 | 7/2009 | Seo et al. | |
| 2009/0238371 | A1 * | 9/2009 | Rumsey et al. | 381/58 |

OTHER PUBLICATIONS

Berg, Jan, "Evaluation of Perceived Spatial Audio Quality", 2006, pp. 10-14, vol. 4, No. 2, *Systemics, Cybernetics and Informatics*.
George, et al., "Feature Extraction for the Prediction of Multichannel Spatial Audio Fidelity", Nov. 2006, pp. 1994-2005, vol. 14, No. 6, *IEEE Transactions on Audio, Speech, and Language Processing*.

(Continued)

*Primary Examiner* — Tan N Tran
(74) *Attorney, Agent, or Firm* — Stites & Harbison PLLC; Douglas E. Jackson

(57) ABSTRACT

The present invention relates to a method and corresponding system for predicting the perceived spatial quality of sound processing and reproducing equipment. According to the invention a device to be tested, a so-called device under test (DUT), is subjected to one or more test signals and the response of the device under test is provided to one or more means for deriving metrics, i.e. a higher-level representation of the raw data obtained from the device under test. The derived one or more metrics is/are provided to suitable predictor means that "translates" the objective measure provided by the one or more metrics to a predicted perceived spatial quality. To this end said predictor means is calibrated using listening tests carried out on real listeners. By means of the invention there is thus provided an "instrument" that can replace expensive and time consuming listening tests for instance during development of various audio processing or reproduction systems or methods.

22 Claims, 28 Drawing Sheets

OTHER PUBLICATIONS

Figure 1A:
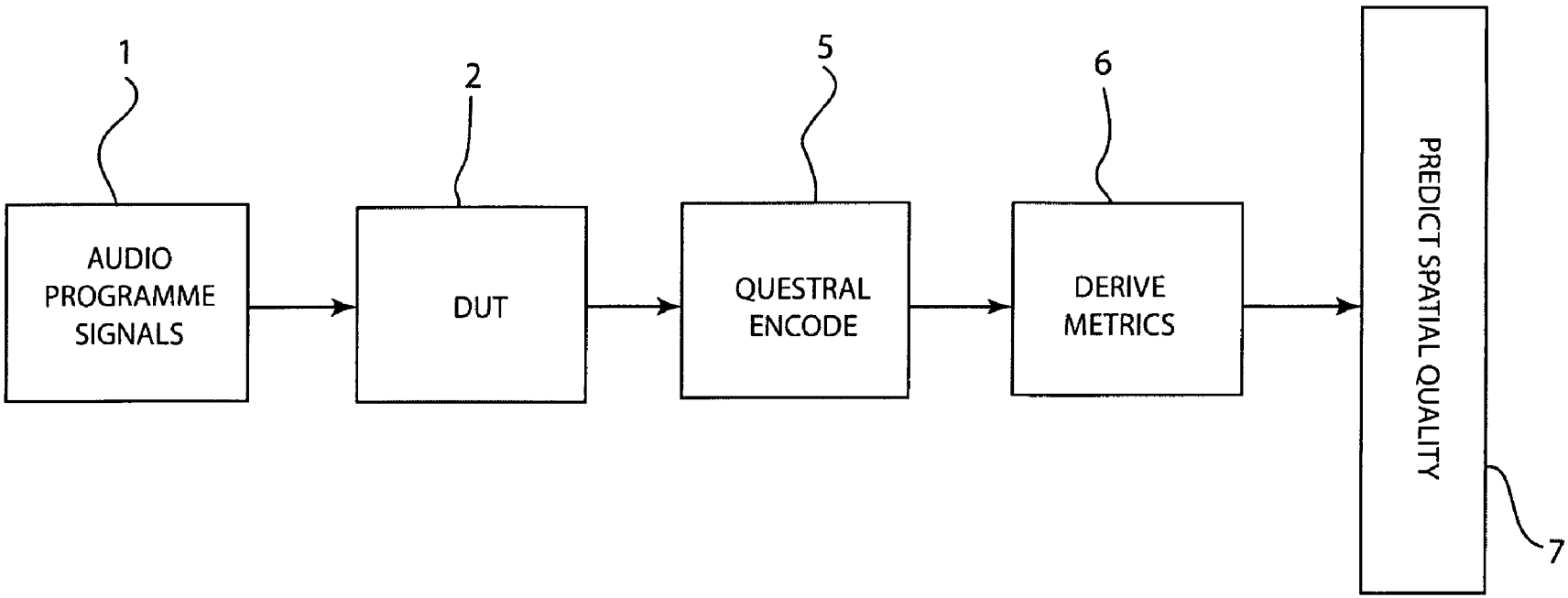

George, et al., "Initial developments of an objective method for the prediction of basic audio quality for surround audio recordings", May 20-23, 2006, Convention Paper 6686, Audio Engineering Society, Paris, France.

Choi, et al., "Prediction of Perceived Quality in Multi-Channel Audio Compression Coding Systems", Mar. 15-17, 2007, pp. 1-9, AES 30$^{th}$ International Conference, Saariselkä, Finland.

Karjalainen, Matti, "A Binaural Auditory Model for Sound Quality Measurements and Spatial Hearing Studies", 1996, pp. 985-988, vol. 2, IEEE International Conference on Acoustics, Speech and Signal Processing.

Kittler, J. and Alkoot, F.M., "Sum versus vote fusion in multiple classifier systems," IEEE Transactions on Pattern Analysis and Machine Intelligence, Jan. 2003, pp. 110-115, vol. 25, No. 1.

Supper, Ben, "An Onset-Guided Spatial Analyser for Binaural Audio," 2005, University of Surrey.

Zielinski et al., "Effects of Down-Mix Algorithms on Quality of Surround Sound," Sep. 2003, pp. 780-798, J. Audio Eng. Soc., vol. 51, No. 9.

* cited by examiner

L: Left channel signal

R: Right channel signal

C: Centre channel signal

LS: Left surround channel signal

RS: Right surround channel signal

"This sound was enveloping"

not at all :___:___:___:___:___:___:___: extremely

Fig. 16

"This sound was "

enveloping :___:___:___:___:___:___:___: not enveloping

Fig. 17

"This sound was enveloping"

5 Strongly agree
4 Agree
3 Neither agree nor disagree
2 Disagree
1 Strongly disagree

Fig. 18

SYSTEM, DEVICES AND METHODS FOR PREDICTING THE PERCEIVED SPATIAL QUALITY OF SOUND PROCESSING AND REPRODUCING EQUIPMENT

TECHNICAL FIELD

The invention relates generally to test systems and methods that enable the prediction of the perceived spatial quality of an audio processing or reproduction system, where the systems and methods apply metrics derived from the audio signals to be evaluated in such a way as to generate predicted ratings that closely match those that would be given by human listeners.

BACKGROUND OF THE INVENTION

It is desirable to be able to evaluate the perceived spatial quality of audio processing, coding-decoding (codec) and reproduction systems without needing to involve human listeners. This is because listening tests involving human listeners are time consuming and expensive to run. It is important to be able to gather data about perceived spatial audio quality in order to assist in product development, system setup, quality control or alignment, for example. This is becoming increasingly important as manufacturers and service providers attempt to deliver enhanced user experiences of spatial immersion and directionality in audio-visual applications. Examples are virtual reality, telepresence, home entertainment, automotive audio, games and communications products. Mobile and telecommunications companies are increasingly interested in the spatial aspect of product sound quality. Here simple stereophony over two loudspeakers, or headphones connected to a PDA/mobile phone/MP3 player, is increasingly typical. Binaural spatial audio is to become a common feature in mobile devices. Home entertainment involving multichannel surround sound is one of the largest growth areas in consumer electronics, bringing enhanced spatial sound quality into a large number of homes. Home computer systems are increasingly equipped with surround sound replay and recent multimedia players incorporate multichannel surround sound streaming capabilities, for example. Scalable audio coding systems involving multiple data rate delivery mechanisms (e.g. digital broadcasting, internet, mobile comms) enable spatial audio content to be authored once but replayed in many different forms. The range of spatial qualities that may be delivered to the listener will therefore be wide and degradations in spatial quality may be encountered, particularly under the most band-limited delivery conditions or with basic rendering devices.

Systems that record, process or reproduce audio can give rise to spatial changes including the following: changes in individual sound source-related attributes such as perceived location, width, distance and stability; changes in diffuse or environment related attributes such as envelopment, spaciousness and environment width or depth. In order to be able to analyse the reasons for overall spatial quality changes in audio signals it may also be desirable to be able to predict these individual sub-attributes of spatial quality.

Under conditions of extreme restriction in delivery bandwidth, major changes in spatial resolution or dimensionality may be experienced (e.g. when downmixing from many loudspeaker channels to one or two). Recent experiments involving multivariate analysis of audio quality show that in home entertainment applications spatial quality accounts for a significant proportion of the overall quality (typically as much as 30%).

Because listening tests are expensive and time consuming, there is a need for a quality model and systems, devices and methods implementing this model that is capable of predicting perceived spatial quality on the basis of measured features of audio signals. Such a model needs to be based on a detailed analysis of human listeners' responses to spatially altered audio material, so that the results generated by the model match closely those that would be given by human listeners when listening to typical programme material. The model may optionally take into account the acoustical characteristics of the reproducing space and its effects on perceived spatial fidelity, either using acoustical measurements made in real spaces or using acoustical simulations.

SUMMARY OF THE INVENTION

Based on the above background it is an object of the present invention to provide systems, devices and methods for predicting perceived spatial quality on the basis of metrics derived from psychoacoustically informed measurements of audio signals. Such signals may have been affected by any form of audio recording, processing, reproduction, rendering or other audio-system-induced effect on the perceived sound field.

The systems, devices and methods operate either in a non-intrusive (single-ended) fashion, or an intrusive (double-ended) fashion. In the former case predictions are made solely on the basis of metrics derived from measurements made on the audio signal(s) produced by a DUT ("device under test", which in the present context means any audio system, device or method that is to be tested by the present invention), when no reference signal(s) is available or desirable. In the latter case, predictions of spatial quality are made by comparing the version of the audio signal(s) produced by the DUT with a reference version of the same signals. This is used when there is a known original or 'correct' version of the spatial audio signal against which the modified version should be compared. As will be described in more detail in the subsequent detailed description of the invention the predictions of spatial audio quality provided by the present invention are basically obtained by the use of suitable metrics that derive objective measures relating to a given auditory space-related quantity or attribute (for instance the location in space of a sound source, the width of a sound source, the degree of envelopment of a sound field, etc.) when said metrics are provided with signals that represent an auditory scene (real or virtual). Alternatively, or additionally, the prediction of spatial audio quality (as a holistic quantity) may be derived from one or more metrics that do not have specifically named attribute counterparts, i.e. individual metrics may be objective measures that are only applied as functional relationships used in the total model for predicting perceived spatial audio quality as a holistic quantity, but with which there may not be associated individual perceptual attributes. The total model, according to a further alternative, utilises a combination of metrics related to perceived attributes and metrics to which there are not related perceived attributes. Said objective measures provided by the respective metrics must be calibrated (or interpreted) properly, so that they can represent a given human auditory perception, either of an individual attribute or of spatial audio quality as a holistic quantity. After translation to this perceptual measure ratings for instance on various scales can be obtained and used for associating a value or verbal assessment to the perceptual measure. Once the system has been calibrated, i.e. a relationship between the objective measures provided by the metrics and the perceptual measure has been established the system can be used for evaluating other auditory scenes and an "instrument" has hence been provided which makes expensive and time consuming listening tests superfluous.

According to the invention raw data relating to audio signals (which may be physical measurements, such as sound pressure level or other objective quantities) are typically made and from these data/measurements are derived metrics that are used as higher-level representations of the raw data/measurements. For example "spectral centroid" is a single value based on a measurement of the frequency spectrum, "iacc0" is the average of iacc in octave bands at two different angles, etc.

According to the invention these higher-level representations are then used as inputs to predictor means (which could be a look-up table, a regression model, an artificial neural network etc.), which predictor means is calibrated against the results of listening tests. According to the invention said objective measures may be derived from said raw data or measurements (physical signals) through a "hierarchy" of metrics. Thus, low-level metrics may be derived directly from the raw data and higher-level metrics may derive the final objective measure from the set of low-level metrics. A schematic representation of this principle according to the invention is given in the detailed description of the invention.

Furthermore, it should be noted that there may not always be just one physical/objective metric that relates to one perceptual attribute. In most cases there are many metrics (e.g. for envelopment) that, appropriately weighted and calibrated, lead to an accurate prediction. Some further clarification will be given in the detailed description of the invention for instance in connection with 2(*b*), 3(*a*) and 3(*b*).

As mentioned, the systems, devices and methods according to the present invention comprise both single-ended ("unintrusive") and a double-ended ("intrusive") versions. These different versions will be described in more detail in the following.

The above and further objects and advantages are according to a first aspect of the present invention obtained by a single-ended (unintrusive) method for predicting the perceived spatial quality of sound processing and reproducing equipment, where the method basically comprises the following steps:

providing an equipment, device, system or method (DUT), the spatial sound processing quality or reproduction of which is to be tested;

providing a test signal;

if necessary, transcoding the test signal to a format appropriate for the particular equipment, device, system or method (DUT), thereby obtaining a transcoded test signal. For instance said test signal may advantageously be a generic signal that after appropriate transcoding, i.e. transformation to a specifically required reproduction format, such as a 5.1 surround sound reproduction format, can be applied to any kind of equipment, devices, systems or methods (algorithms), the auditory spatial processing/reproduction quality of which is to be tested.

providing said test signal or said transcoded test signal to said equipment, device, system or method (DUT);

measuring or recording one or more reproduced or processed signals (output signals) from said equipment, device, system or method (DUT);

applying one or more metrics to said one or more reproduced or processed signals (output signals), where said one or more metrics is/are designed for providing a physical measure of either said spatial quality as a holistic quantity or for providing physical measures of specific auditory attributes related to said spatial quality. Said one or more metrics may be able directly to accept signals provided by or picked up in said equipment, device, system or method (DUT) or it may be required to encode ("QESTRAL encode" in the following) these signals before they can be applied as input signals to the subsequent metrics;

during a calibration procedure establishing a relationship or correlation between said physical measure(s) and spatial quality assessments or ratings obtained from listening tests carried out on real listeners;

applying said relationship or correlation to the output (the physical measure) from one or more of said metrics thereby to obtain a prediction of the perceived spatial quality (holistic or relating to specific spatial attributes) provided by said DUT.

The above and further objects and advantages are according to a first aspect of the present invention alternatively obtained by a double-ended (intrusive) method for predicting the perceived spatial quality of sound processing and reproducing equipment, where the method basically comprises the following steps:

providing an equipment, device, system or method (DUT), the spatial sound processing quality or reproduction of which is to be tested;

providing a test signal; if necessary, transcoding the test signal to a format appropriate for the particular equipment, device, system or method (DUT), thereby obtaining a transcoded test signal. For instance said test signal may advantageously by a generic signal that after appropriate transcoding, i.e. transformation to a specifically required reproduction format, such as a 5.1 surround sound reproduction format, can be applied to any kind of equipment, devices, systems or methods (algorithms), the auditory spatial processing/reproduction quality of which is to be tested;

providing said test signal or said transcoded test signal to said equipment, device, system or method (DUT);

measuring or recording one or more reproduced or processed signals (output signals) from said equipment, device, system or method (DUT);

applying one or more metrics to said one or more reproduced or processed signals (output signals), where said one or more metrics is/are designed for providing a physical measure of either said spatial quality as a holistic quantity or for providing physical measures of specific auditory attributes related to said spatial quality. Said one or more metrics may be able directly to accept signals provided by or picked up in said equipment, device, system or method (DUT) or it may be required to encode ("QESTRAL encode" in the following) these signals before they can be applied as input signals to the subsequent metrics;

providing either the test or the transcoded test signal to a reference equipment, system, device or method. The term: "reference equipment, system, device or method" is within the context of the present invention to be interpreted broadly. Thus, the reference may for instance be a standard loudspeaker set-up with which an alternative loudspeaker set-up is to be compared. The standard could also for instance be a known signal processing method or algorithm with which an alternative, new method or algorithm is to be compared. The standard could even be the test signal (or a transcoded version hereof) itself that might represent the optimal reproduction or processing of the test signal.

measuring or recording one or more reproduced or processed signals from said reference equipment, device, system or method;

applying one or more metrics to said one or more reproduced or processed signals, where said one or more metrics is/are designed for providing a physical measure of either said spatial quality as a holistic quantity or for providing physical measures of specific auditory attributes related to said spatial quality. Said one or more metrics may be able directly to accept signals provided by or picked up in said equipment, device, system or method (DUT) or it may be required to encode ("QESTRAL encode" in the following) these signals before they can be applied as input signals to the subsequent metrics;

providing output signals from said metrics applied on said DUT and said reference equipment, system, device or method, respectively;

carrying out a comparison or forming a difference between the outputs from the metrics from said DUT and said reference equipment, system, device or method, said comparison or difference forming a relative measure for predicting a difference between spatial attributes of the DUT and the reference equipment, system, device or method;

during a calibration procedure establishing a relationship or correlation between said relative measure for predicting a difference between spatial attributes of the DUT and the reference equipment, system, device or method and spatial quality ratings obtained from listening tests carried out on real listeners;

applying said relationship or correlation to the output of said comparison or difference, thereby to obtain a prediction of the perceived spatial quality difference (holistic or relating to specific spatial attributes) between said DUT and said reference equipment, system, device or method.

The above and further objects and advantages are according to a second aspect of the present invention obtained by a system for predicting the perceived spatial quality of sound processing and reproducing equipment, where the system basically comprises:

means (1) for providing a test signal for provision to a DUT (2);

means for receiving processed or reproduced versions of said test signals from said DUT (2);

one or more metric means (6) that, when provided with said processed or reproduced versions of the test signals from the DUT (2), provides one or more physical measures relating to either perceived auditory spatial quality as a holistic quantity or to one or more specific attributes characterising said perceived auditory spatial quality;

rained or calibrated interpretation means (7) for translating said one or more physical measures to perceptual assessments or ratings characterising either said perceived auditory spatial quality as a holistic quantity or said one or more specific attributes characterising said perceived auditory spatial quality.

The above and further objects and advantages are according to the second aspect of the present invention alternatively obtained by a double-ended (intrusive) system for predicting the perceived spatial quality of sound processing and reproducing equipment, where the system basically comprises:

means (1) for providing a test signal for provision to a DUT (2) and to a reference equipment, device, system or method (Ref) (4). (It is noted that as a specific example the "reference equipment etc." may be an ideal transmission path, i.e. the result of the processing of the test signals carried out by the DUT may be compared with the test signal itself.)

means for receiving processed or reproduced versions of said test signals from said DUT (2);

one or more metric means (6) that, when provided with said processed or reproduced versions of the test signals from the DUT (2), provides one or more physical measures (m1) relating to either perceived auditory spatial quality as a holistic quantity or to one or more specific attributes characterising said perceived auditory spatial quality;

means for receiving processed or reproduced versions of said test signals from said reference equipment, device, system or method Ref (4);

one or more metric means (6) that, when provided with processed or reproduced versions of the test signals from the reference equipment, device, system or method Ref (4) provides one or more physical measures (m2) relating to either perceived auditory spatial quality as a holistic quantity or to one or more specific attributes characterising said perceived auditory spatial quality;

means (9) for comparing or forming a difference (C) between said physical measures (m1, m2), said means (9) thereby forming a relative measure for predicting a difference between spatial attributes of the DUT and the reference equipment, device, system or method Ref (4);

trained or calibrated interpretation means (10) for translating said difference (C) to perceptual assessments or ratings characterising either a perceived auditory spatial quality difference as a holistic quantity or one or more specific attributes characterising said perceived auditory spatial quality difference.

The present invention furthermore relates to various specific devices (or functional items or algorithms) used for carrying out the different functions of the invention.

Still further the present invention also relates to specific methods for forming look-up tables that translates a given physical measure provided by one or more of said metrics into a perceptually related quantity or attribute. One example would be a look-up table for transforming the physical measure: interaural time difference (ITD) into a likely azimuth angle of a sound source placed in the horizontal plane around a listener. Another example would be a look-up table for transforming the physical measure: interaural cross-correlation to the perceived width of a sound source. It should be noted that instead of using look-up tables that comprise columns and rows defining cells, where each cell contains a specific numerical value in the method and system according to the invention other equivalent means, such as regression models showing the regression (correlation) between one or more physically related quantities provided by metrics in the system and a perceptually related quantity that constitutes the desired result of the evaluation carried out by the system may be used. Also artificial neural networks may be used as prediction means according to the invention.

Generally, the regression models (equations) or equivalent means such as a look-up table or artificial neural network used according to the invention weights the individual metrics according to calibrated values.

The present invention incorporates one or more statistical regression models, look-up tables or said equivalent means of weighting and combining the results of the derived metrics so as to arrive at an overall prediction of spatial quality or predictions of individual attributes relating to spatial quality.

The present invention furthermore relates to a metric or method for prediction of perceived azimuth angle θ based on interaural differences, such as interaural time difference (ITD) and/or interaural level (or intensity) difference (ILD), where the method comprises the following steps:

providing left and right ear signals (L, R);

filtering said left and right ear signals (L, R) in a filter bank comprising a plurality of band pass filters with predetermined bandwidths or in equivalent means, thereby providing band pass filtered versions of said left and right ear signals;

rectifying and low pass filtering each of said band pass filtered versions;

for each of said frequency bands deriving ITD and ILD thereby providing a set of ITD(fi) and ILD(fi), where fi designates each individual frequency band;

for each frequency band providing said ITD(fi) and ILD(fi) to histogram means that establishes a relation between ITD(fi) and a corresponding distribution $D_{ITD}(\theta)$ of azimuth angles and between ILD(fi) and a corresponding distribution $D_{ILD}(\theta)$ of azimuth angles, respectively;

based on said distributions $D_{ITD}(\theta)$ and $D_{ILD}(\theta)$ calculating a predicted azimuth angle as a function of $D_{ITD}(\theta)$ and $D_{ILD}(\theta)$.

Said frequency bands are according to a specific embodiment of the invention bands of critical bandwidth ("critical bands").

The present invention also relates to systems or devices able to carry out the above method for prediction of perceived azimuth angle.

The present invention furthermore relates to a metric or method for predicting perceived envelopment, the method comprising the steps of:

providing a set of input signals;

based on said set of input signals extracting a set of physical features characterising envelopment;

providing said set of physical features to predictor means that establishes a relation between said set of physical features and a predicted perceived envelopment, i.e. the degree of envelopment that with a high probability would have been obtained, had a group of real listeners listened to said input signals.

The present invention also relates to systems or devices able to carry out the above method for predicting perceived envelopment.

Within the context of the present invention a division is made between foreground (F) attributes and background (B) attributes. Foreground refers to attributes describing individually perceivable and localizable sources within the spatial auditory scene, whereas background refers to attributes describing the perception of diffuse, unlocalisable sounds that constitute the perceived spatial environment components such as reverberation, diffuse effects, diffuse environmental noise etc. These provide cues about the size of the environment and the degree of envelopment it offers to the listener. Metrics and test signals designed to evaluate perceived distortions in the foreground and background spatial scenes can be handled separately and combined in some weighted proportion to predict overall perceived spatial quality.

Foreground location-based (FL) attributes are related to distortions in the locations of real and phantom sources. (e.g. individual source location, Direct envelopment, Front/rear scene width, Front/rear scene skew)

Foreground width-based (FW) attributes are related to distortions in the perceived width or size of individual sources (e.g. individual source width).

Background (B) attributes relate to distortions in diffuse environment-related components of the sound scene that have perceived effects, such as Indirect envelopment, Environment width/depth (spaciousness).

DETAILED DESCRIPTION OF THE INVENTION

Figure 1B:
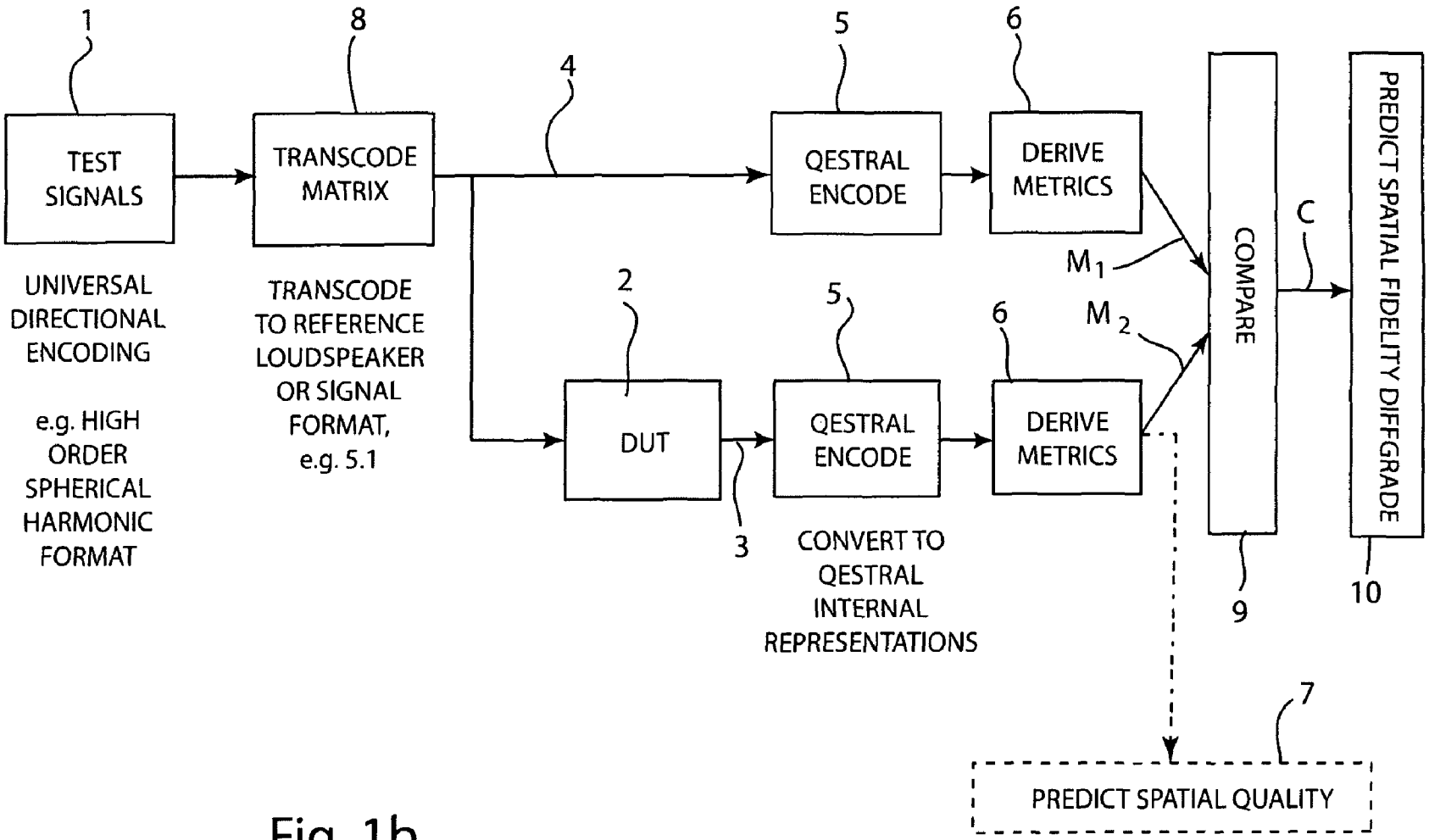
Figure 2A:
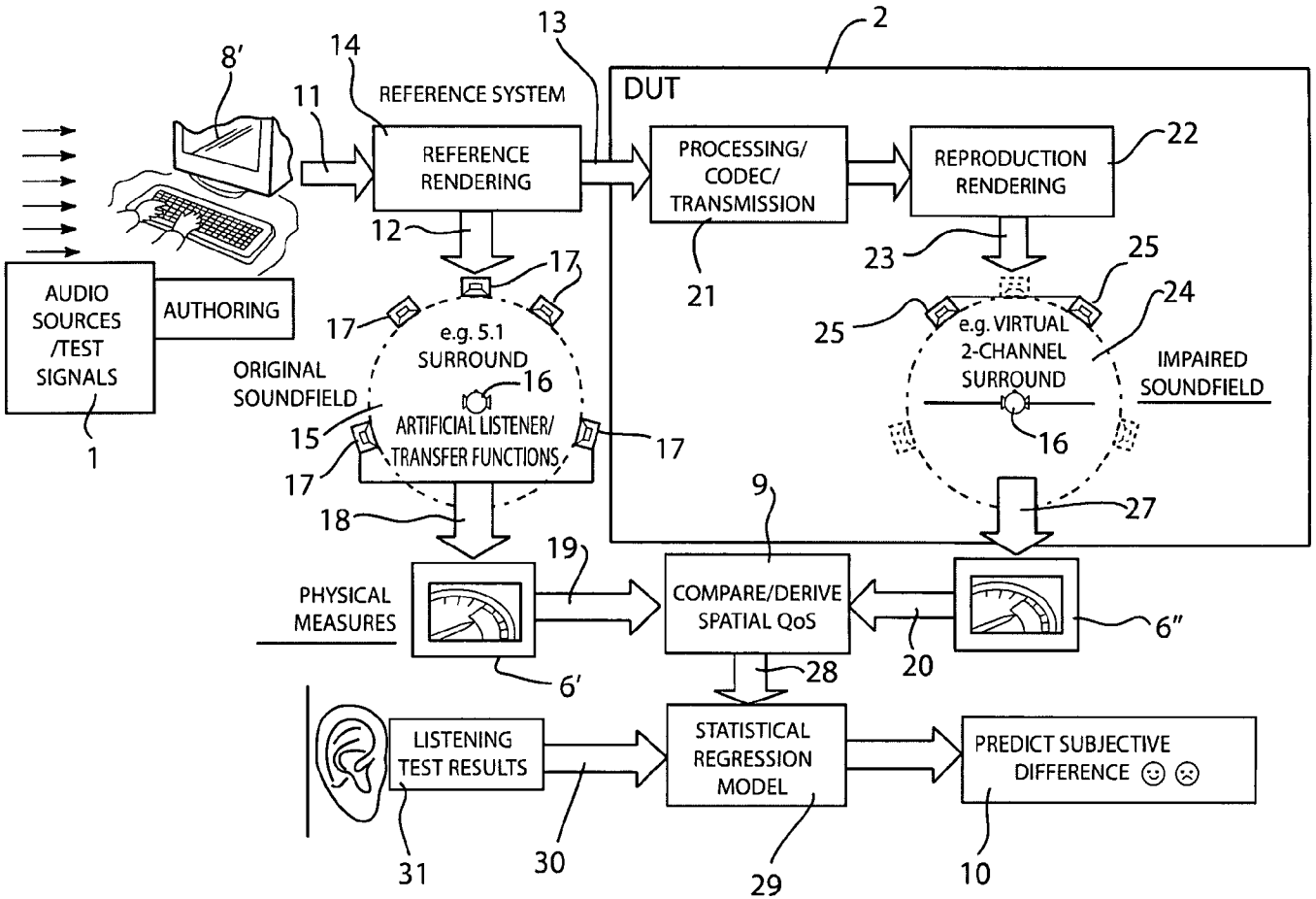
Figure 2B:
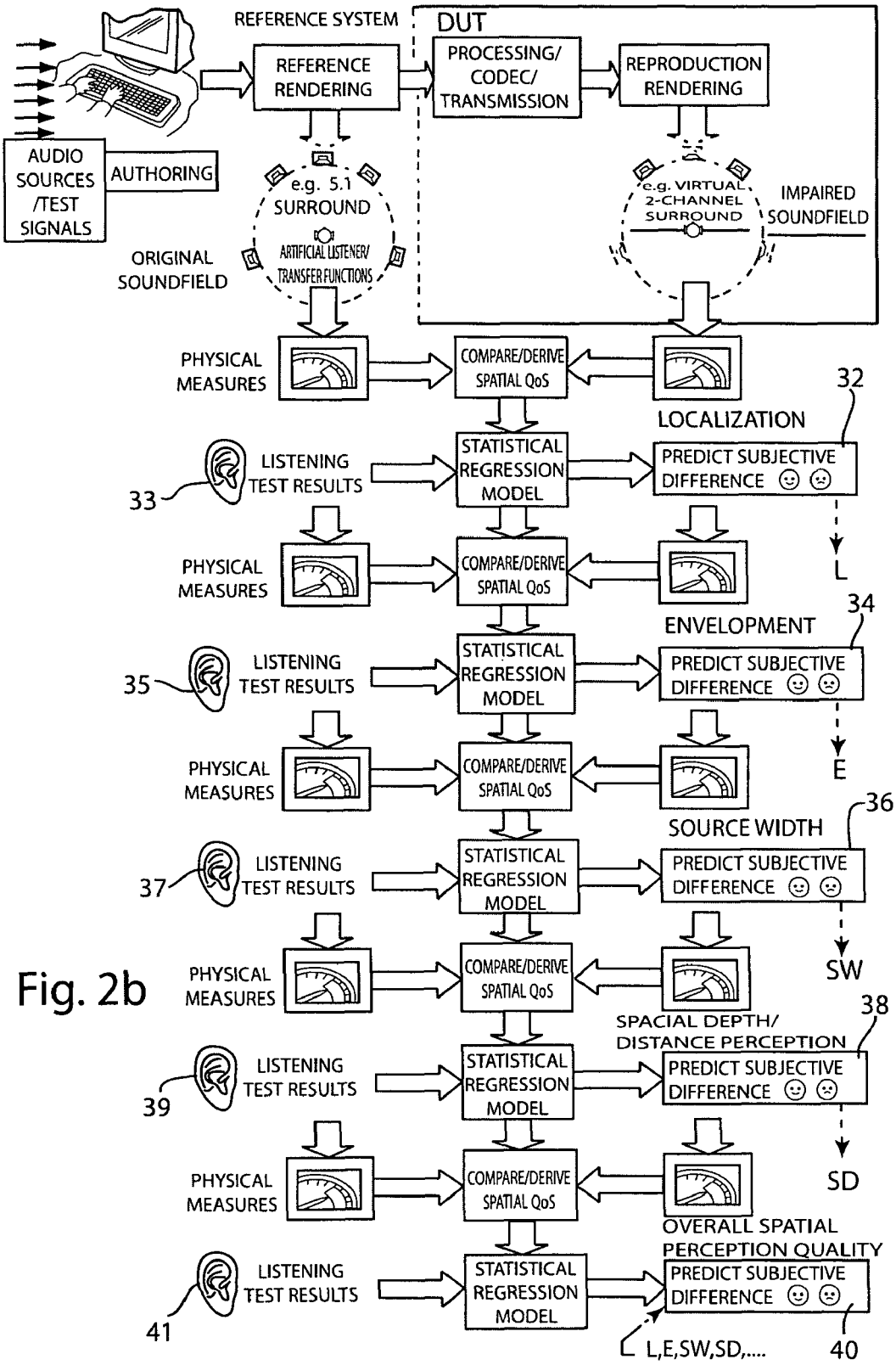
Figure 3A:
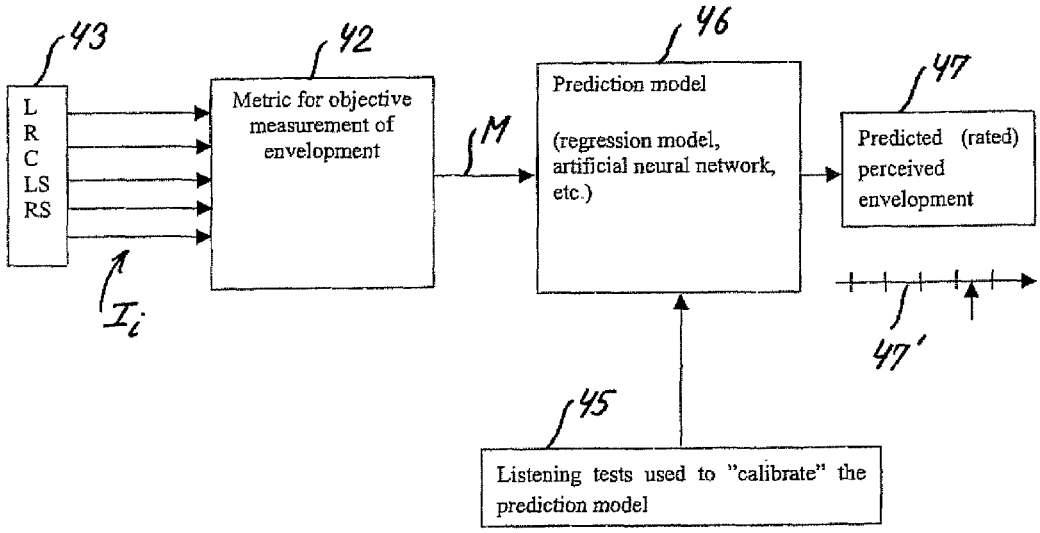
Figure 3B:
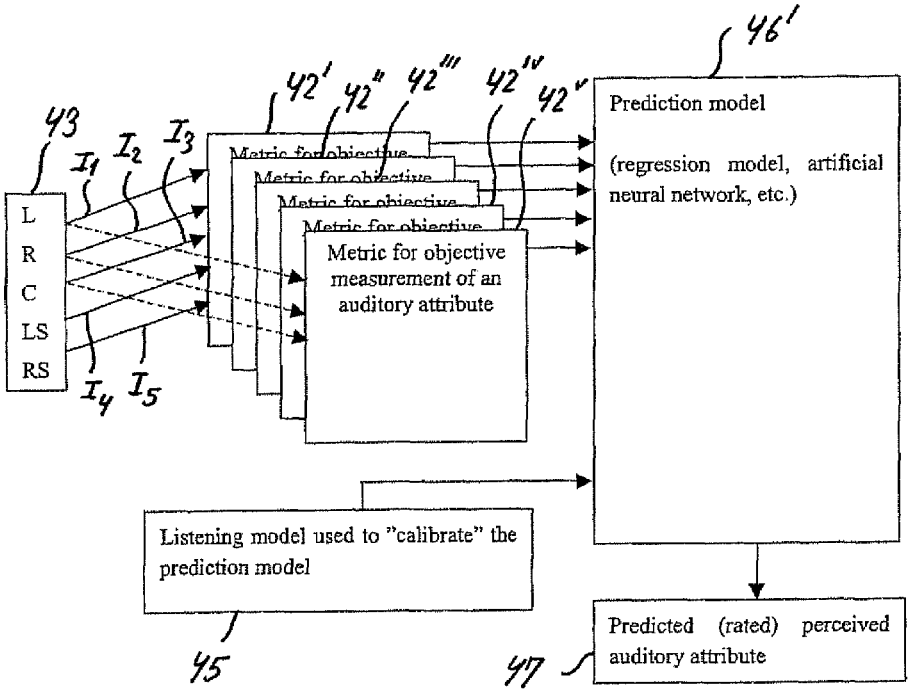
Figure 3C:
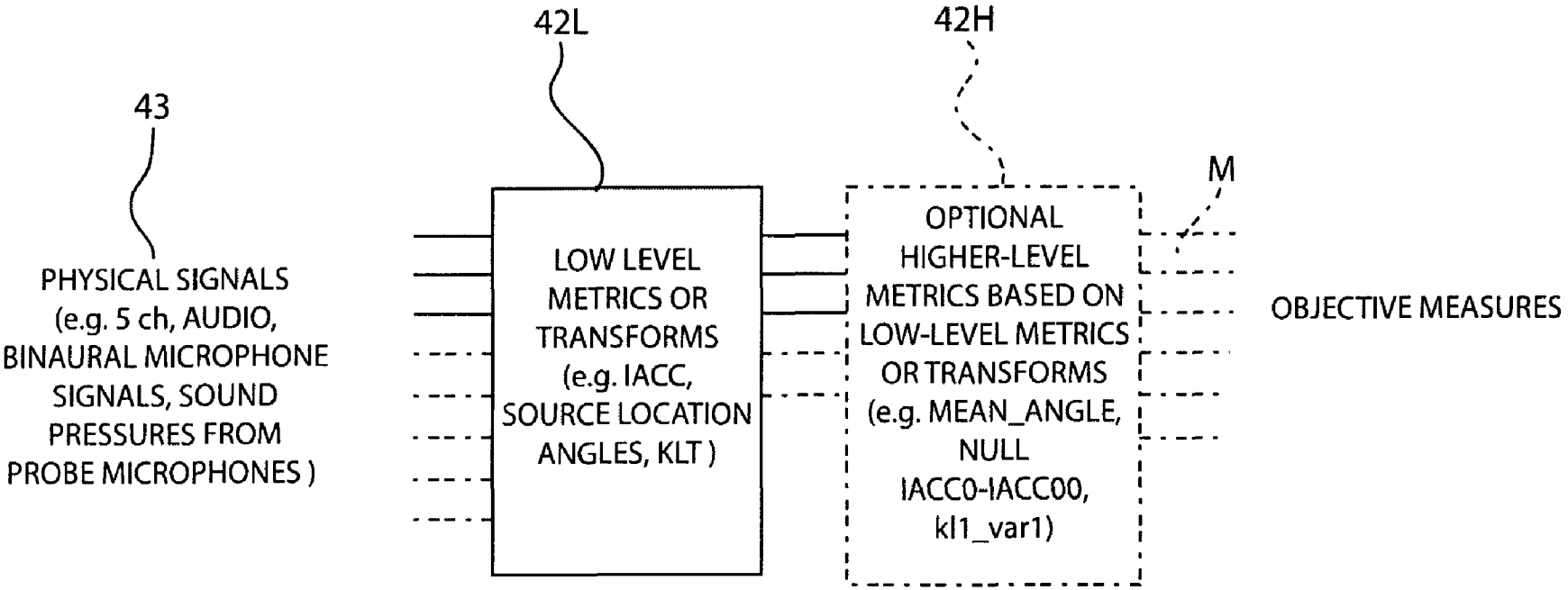
Figure 4:
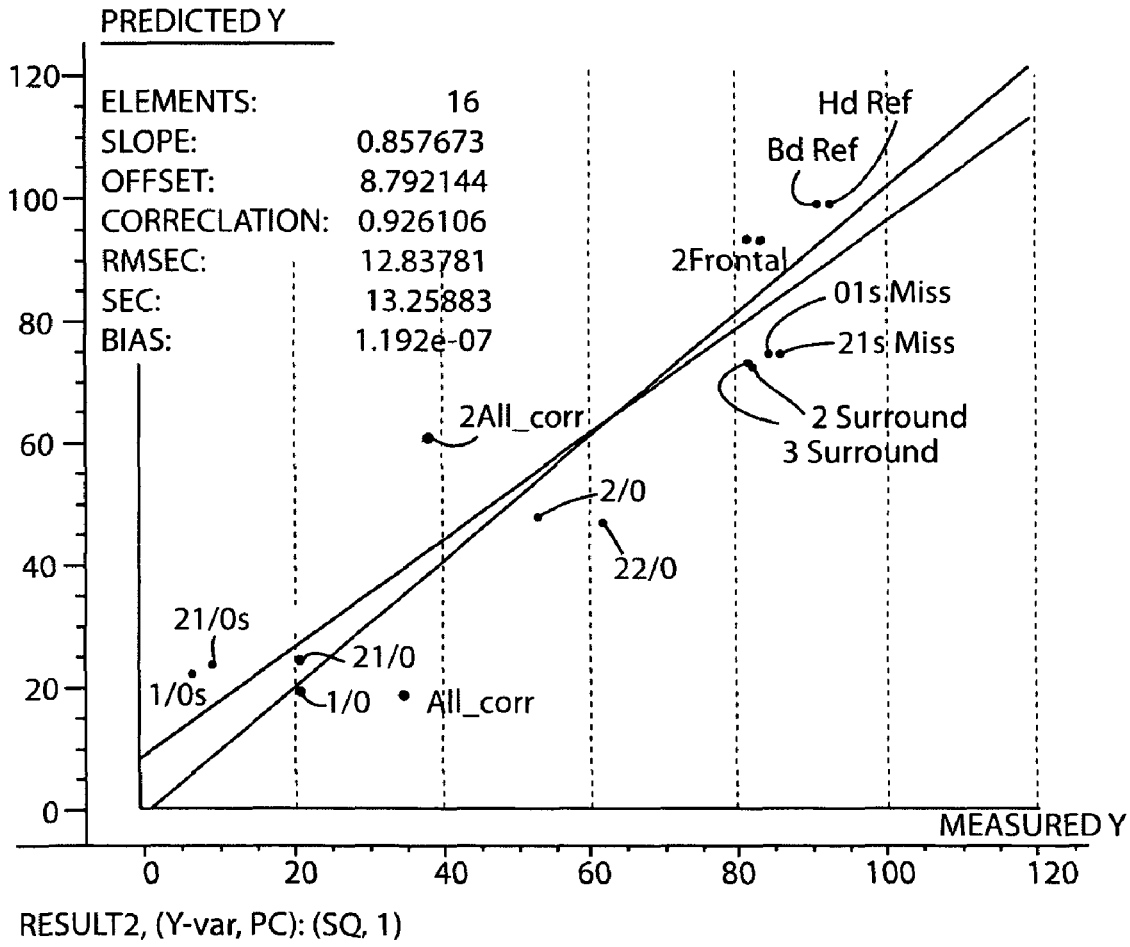
Figure 5:
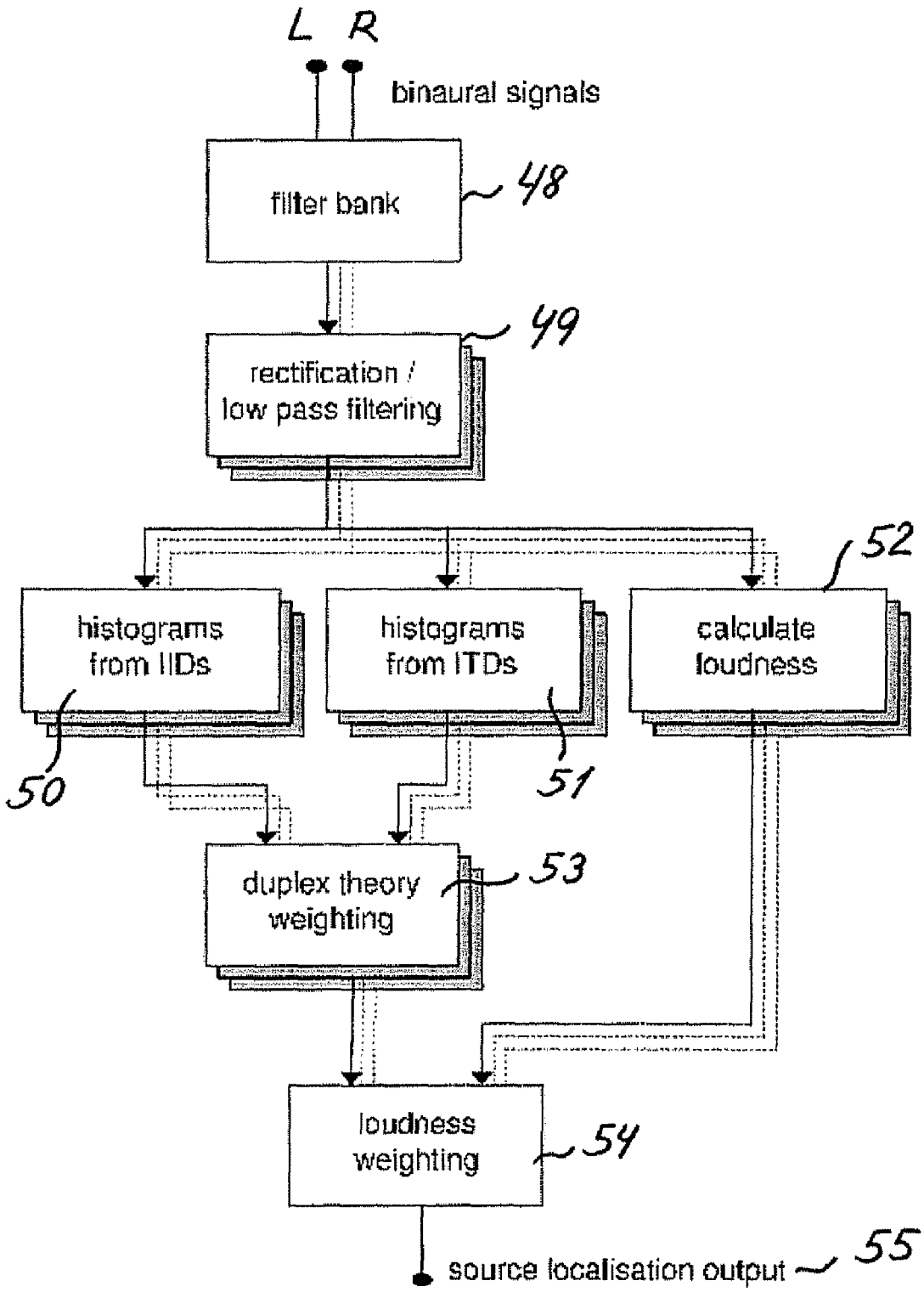

The invention will be better understood with reference to the following detailed description of embodiments hereof in conjunction with the figures of the drawing, where:

FIG. 1*a* illustrates a first embodiment of the invention in the form of unintrusive evaluation using audio programme material as a source, although the input to the DUT (i.e. the Device Under Test, which means any combination of the recording, processing, rendering or reproducing elements of an audio system) according to another option may be customised/dedicated test signals for instance aiming at highlighting specific auditory attributes or spanning the complete range of auditory perception;

FIG. 1*b* illustrates a second embodiment of the invention in the form of intrusive evaluation basically comprising comparison between signals processed by the DUT and a reference signal, i.e. a signal that has not been processed by the DUT; also in this embodiment the input signals may be either audio programme material or customised/dedicated signals as mentioned in connection with FIG. 1*a* above;

FIG. 2*a* exemplifies the general concept of a system according the second embodiment of the invention using the intrusive approach as mentioned in connection with FIG. 1*b* above;

FIG. 2*b* gives a further example of the general concept of a system according to the second embodiment of the invention comprising prediction of separate attributes related to perceived auditory spatial quality and also prediction of perceived auditory spatial quality as a holistic quantity;

FIG. 3*a* shows a schematic representation of the principle of the invention, illustrating a set-up where a set of raw data are provided to a metric means that based on the raw data provides a higher-level representation relating to a given perceptive attribute (holistic or specific), where this higher-level representation is subsequently provided to predictor means that are calibrated on the basis of listening tests and which predictor means provides a prediction of the given perceptive attribute (holistic or specific);

FIG. 3*b* shows a further schematic representation of the principle of the invention, according to which a plurality of metrics are provided as input to the prediction model;

FIG. 3*c* shows schematically the relationship between raw data (physical signals), low-level metrics, high-level metrics and objective measures;

FIG. 4 shows an example of the prediction accuracy of the regression model for predicted spatial quality as a holistic quantity;

FIG. 5. Main processing blocks that implement extraction of binaural cues and conversion into an estimate of the sound localisation.

Figure 6:
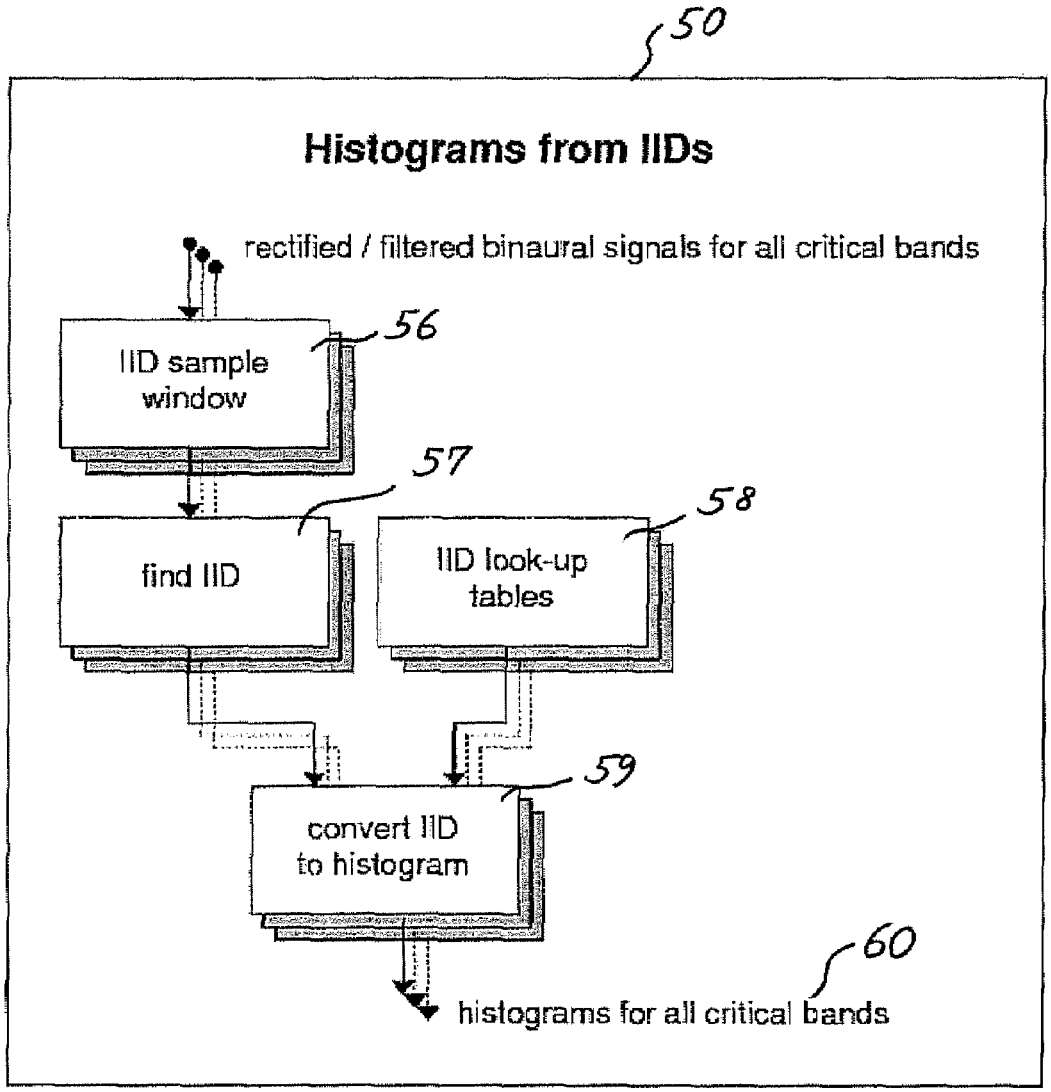

FIG. 6. Detail of the processing for ILDs showing pairs of filter-bank signals being used to extract the localisation cue and a corresponding look-up table to convert the localisation cue into a posterior probability of the localisation angle based on that localisation cue. The result is a set of angle histograms based on the ILD for each frequency band.

Figure 7:
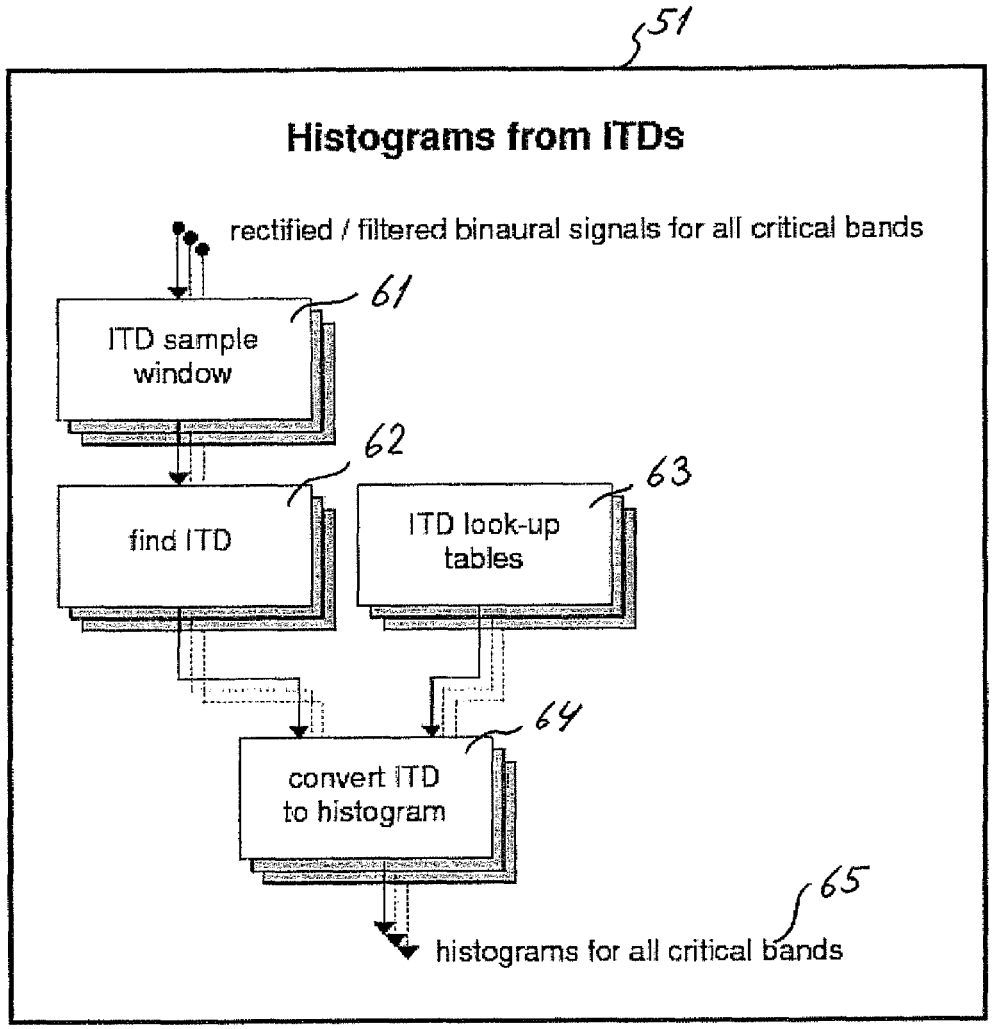

FIG. 7. Detail of the processing for ITDs showing pairs of filter-bank signals being used to extract the localisation cue and a corresponding look-up table to convert the localisation cue into a posterior probability of the localisation angle based on that localisation cue. The result is a set of angle histograms based on the ITD for each frequency band.

FIG. 8*a* to 8*d*. Example of a look-up table: (a) the likelihoods of ITD values against the azimuth angle relative to the listener's head (in this case, of an acoustical dummy), which were obtained from training data for filter-bank channel 12, (b) with some smoothing applied, the grey level indicating the strength of the likelihood with black being the highest. The proposed system performs vertical (c) and horizontal (d) normalizations of this table to produce estimates of the probability of an angle given the ITD.

Figure 8A:
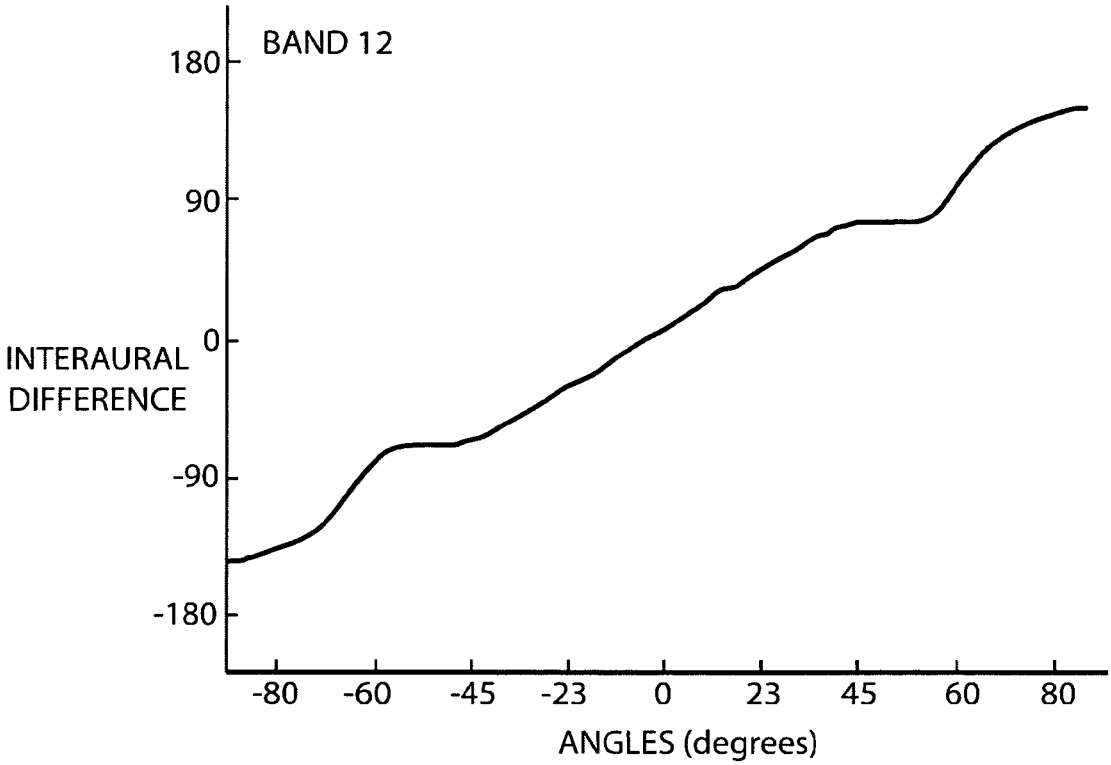
Figure 8B:
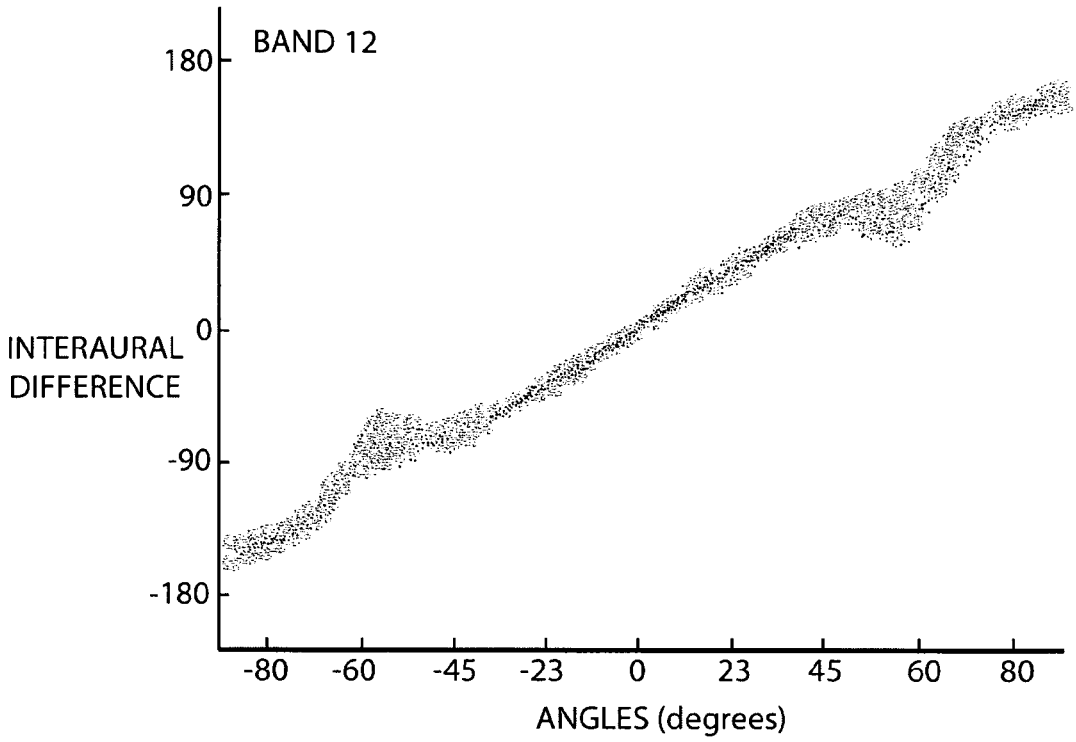
Figure 8C:
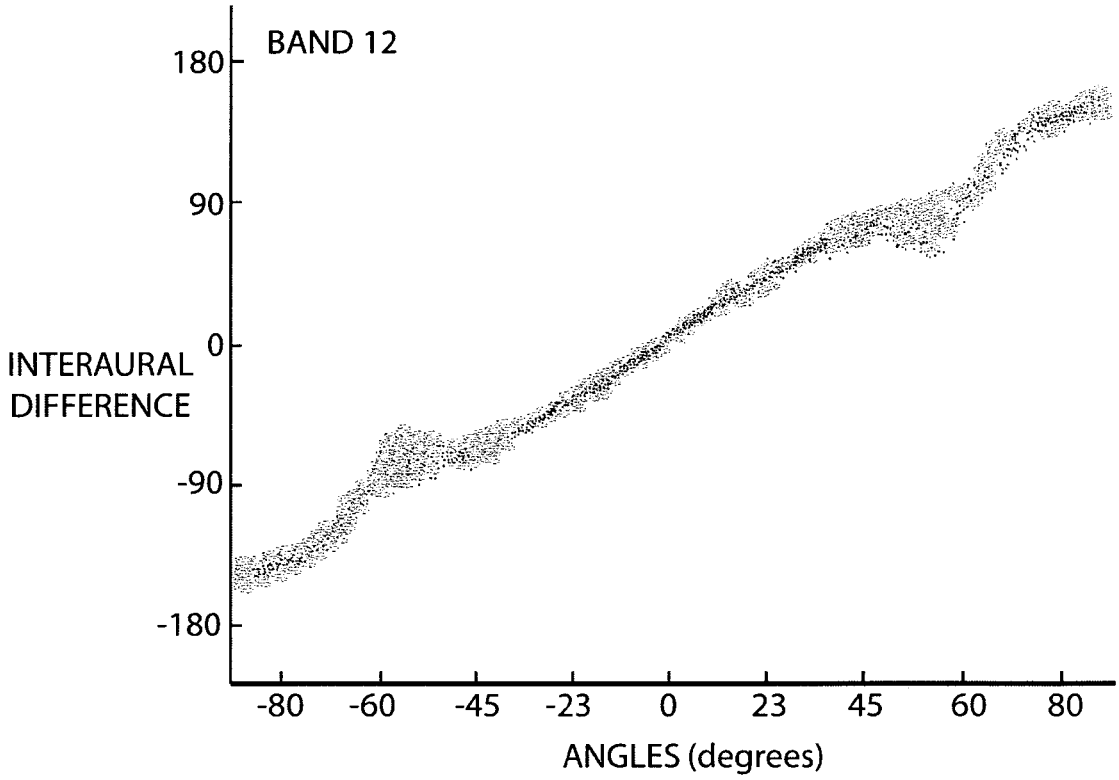
Figure 8D:
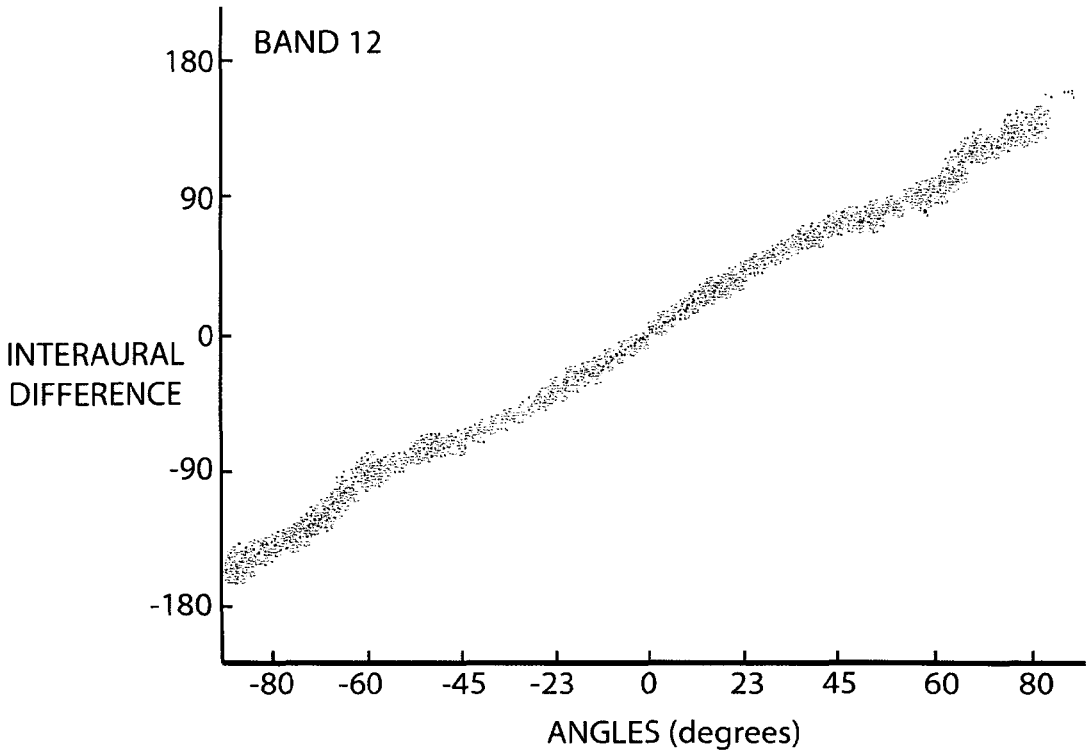
Figure 8E:
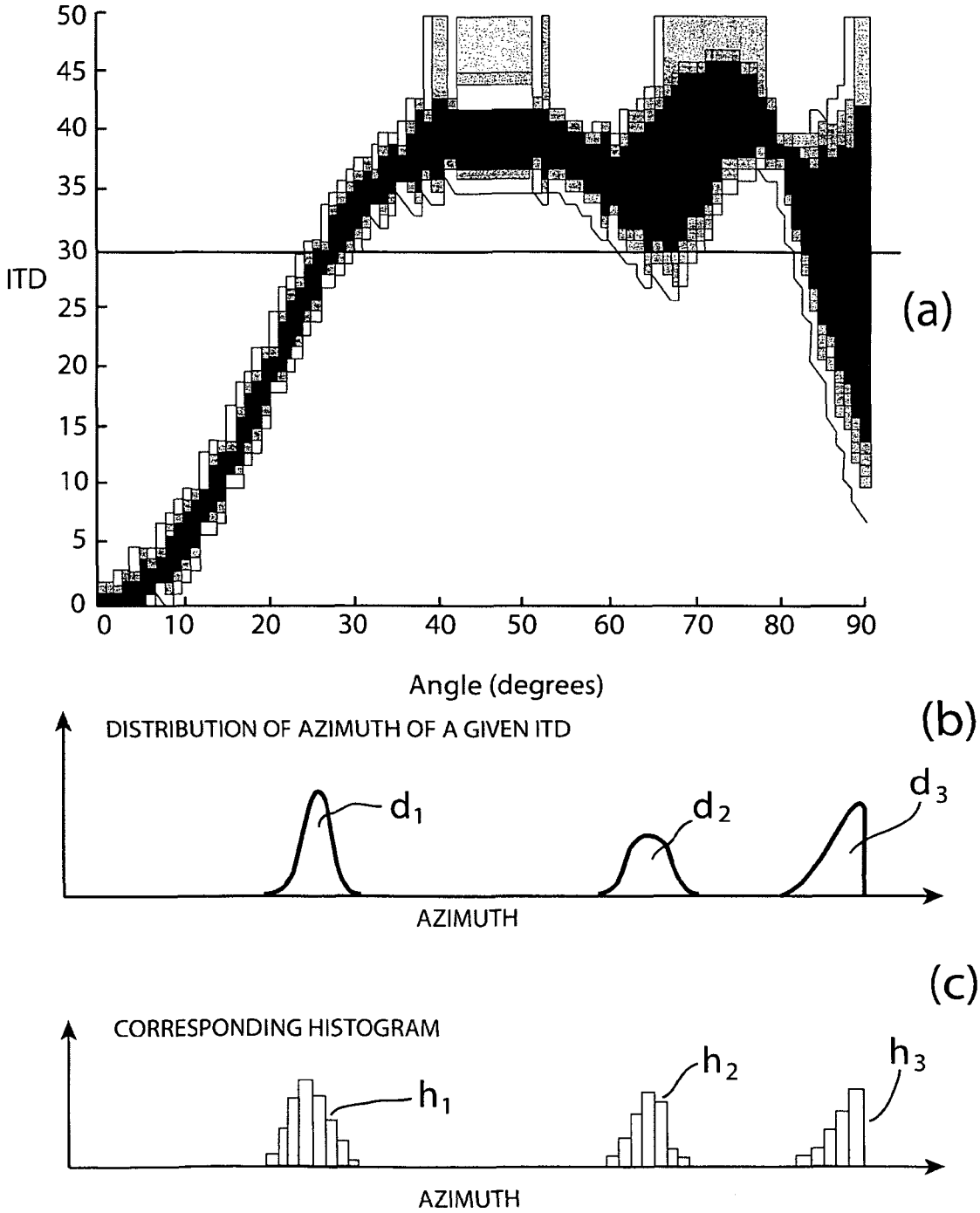
Figure 9:
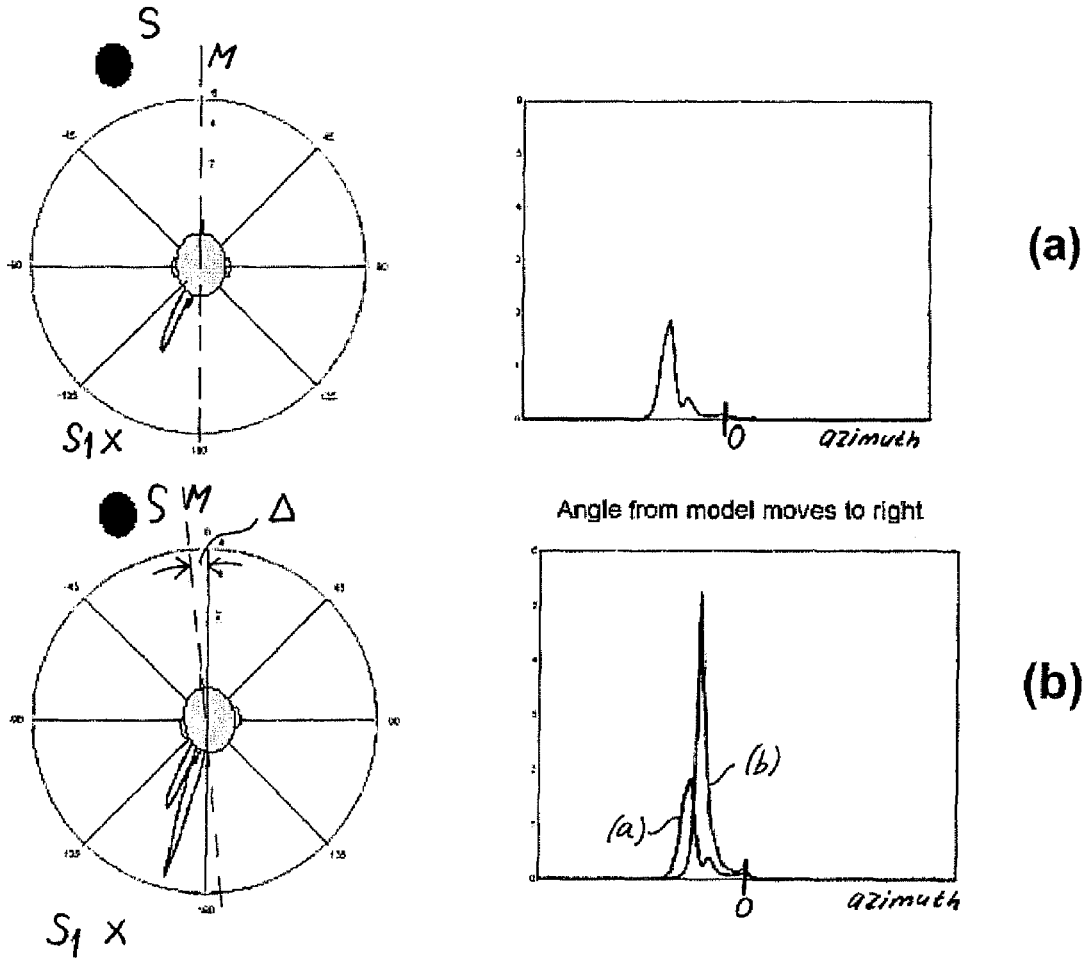

FIGS. 8*e* and *f*. Illustration of the procedure according to the invention for forming a histogram corresponding to a single, given frequency band;

FIGS. 9*a* and *b*. Illustration of the use of head movement used according to the invention to resolve front/back ambiguity.

Figure 10:
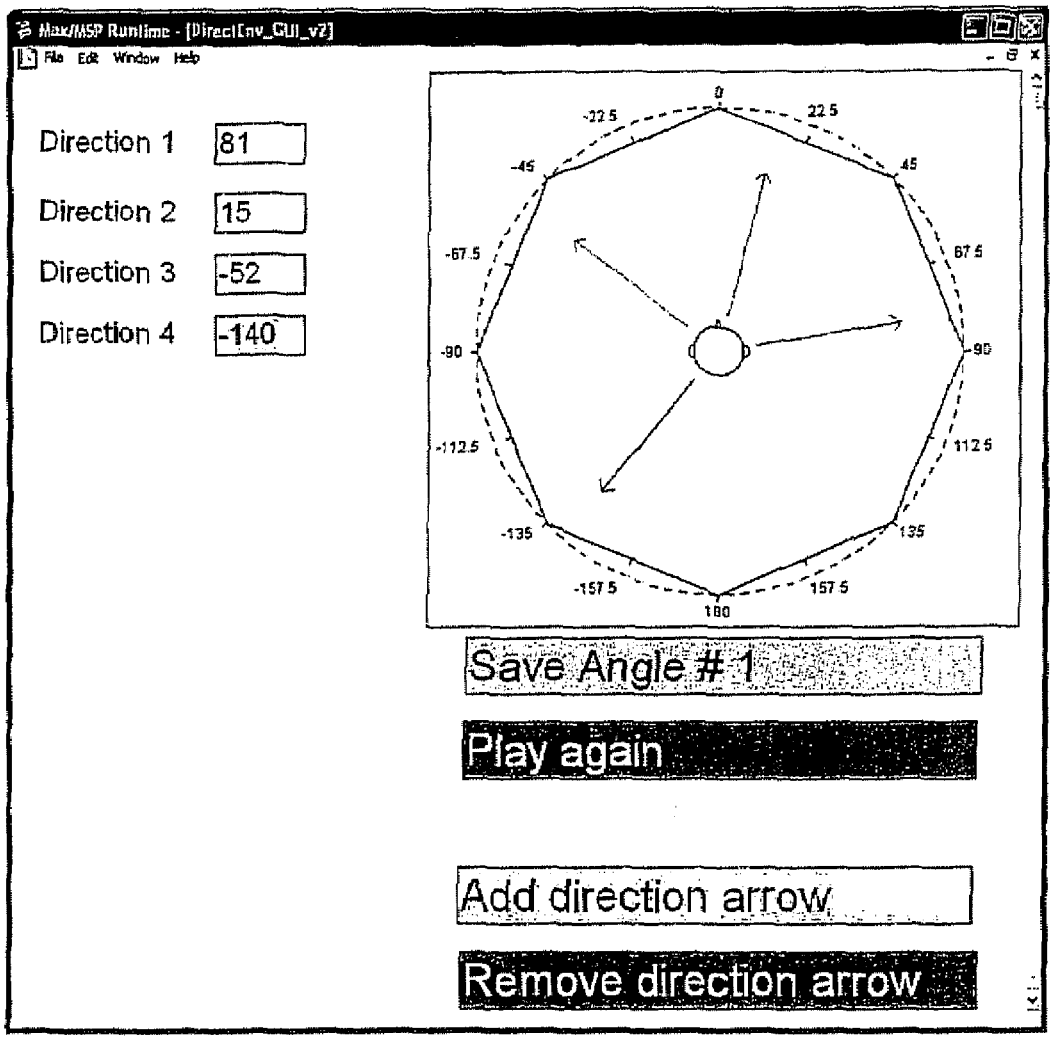

FIG. 10. Illustration of the kind of user interface used to elicit multiple source location estimates from participants in listening tests.

Figure 11:
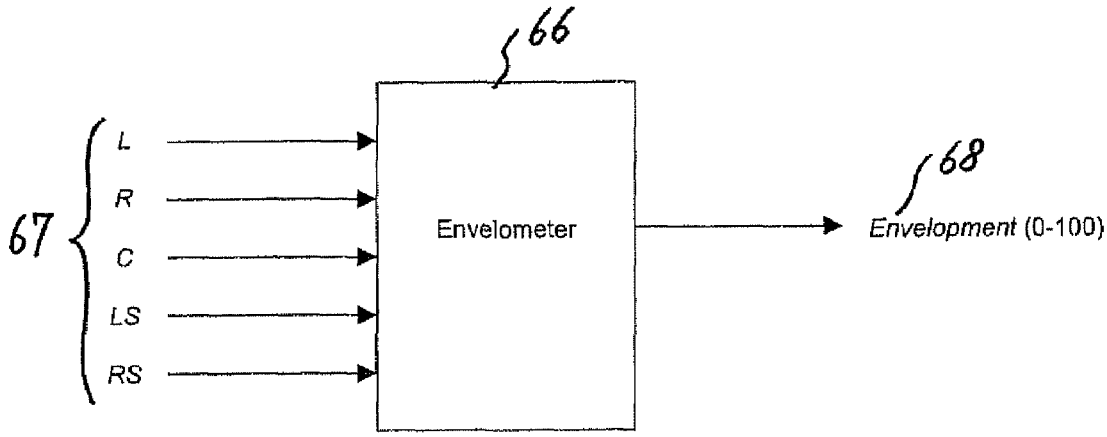

FIG. 11. A schematic block diagram of an embodiment of an envelometer according to the invention specifically for prediction the perceived degree of envelopment of a five-channel surround sound set-up as illustrated in figure yy.

Figure 12:
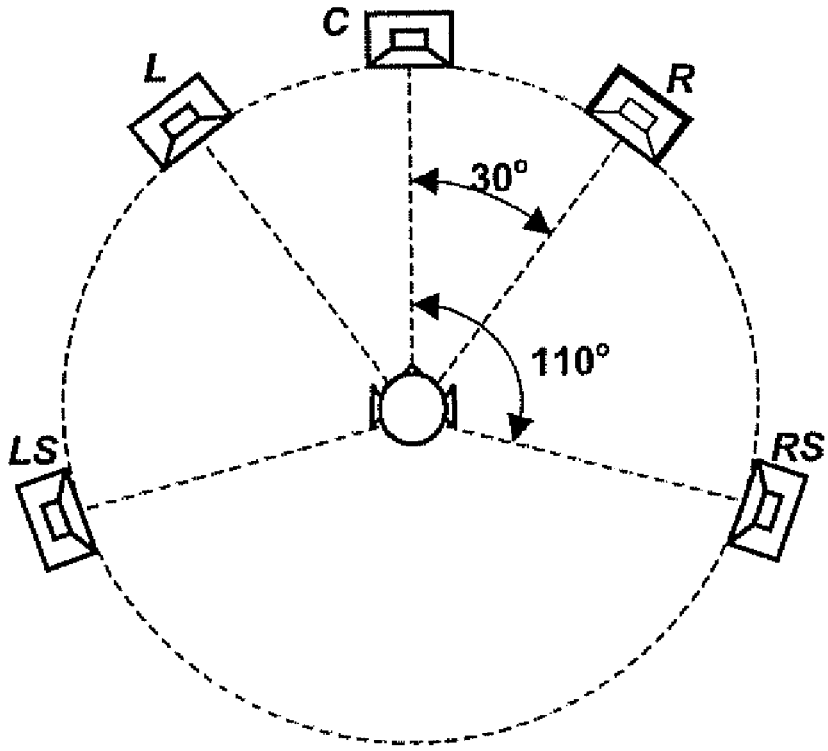

FIG. 12. A schematic representation of a five-channel surround sound loudspeaker set-up according to the ITU-R BS. 775 Recommendation.

Figure 13:
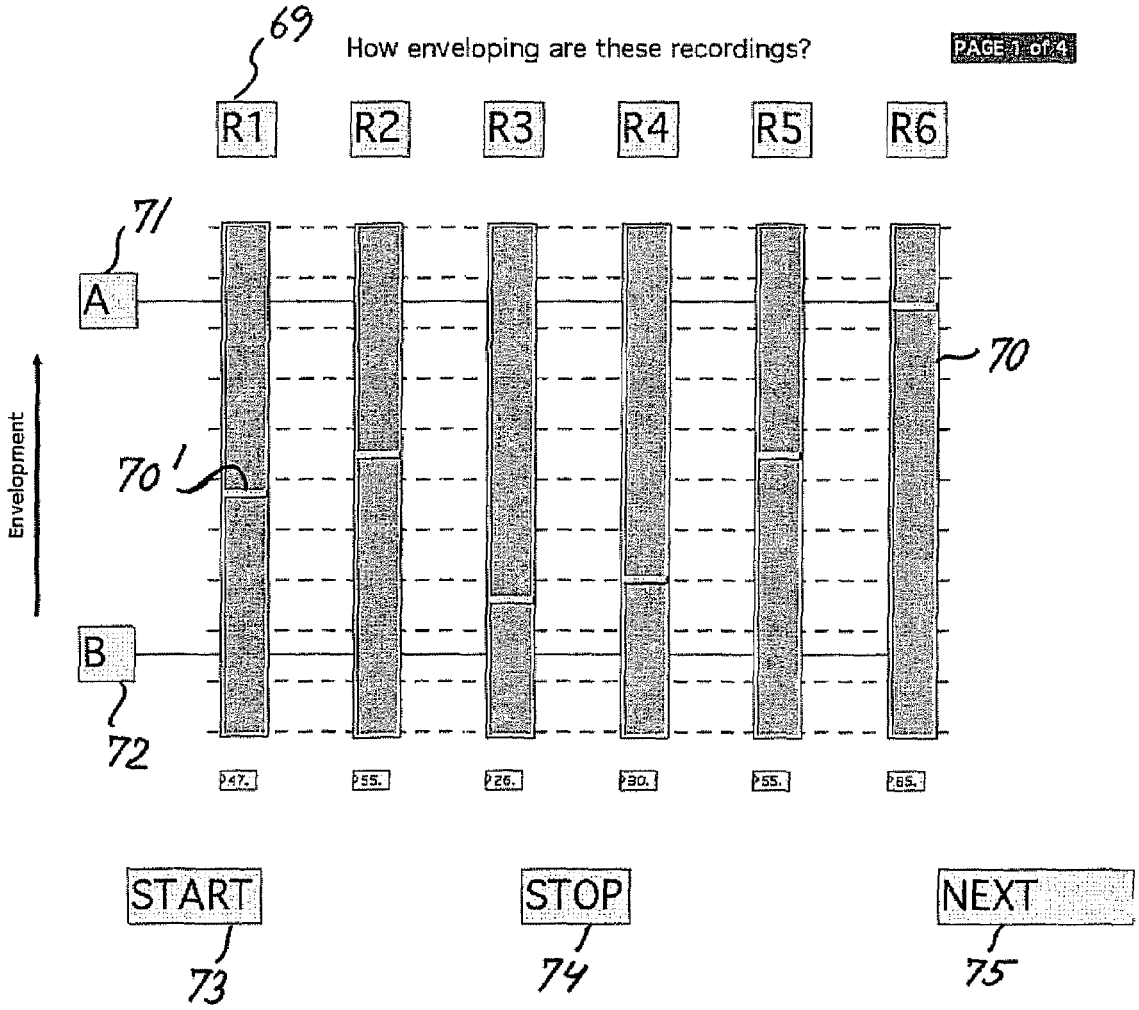

FIG. 13. Interface used in the listening tests with two auditory anchors (A and B). The anchors provide a listener with a "frame of reference" and hence calibrate the scale.

Figure 14:
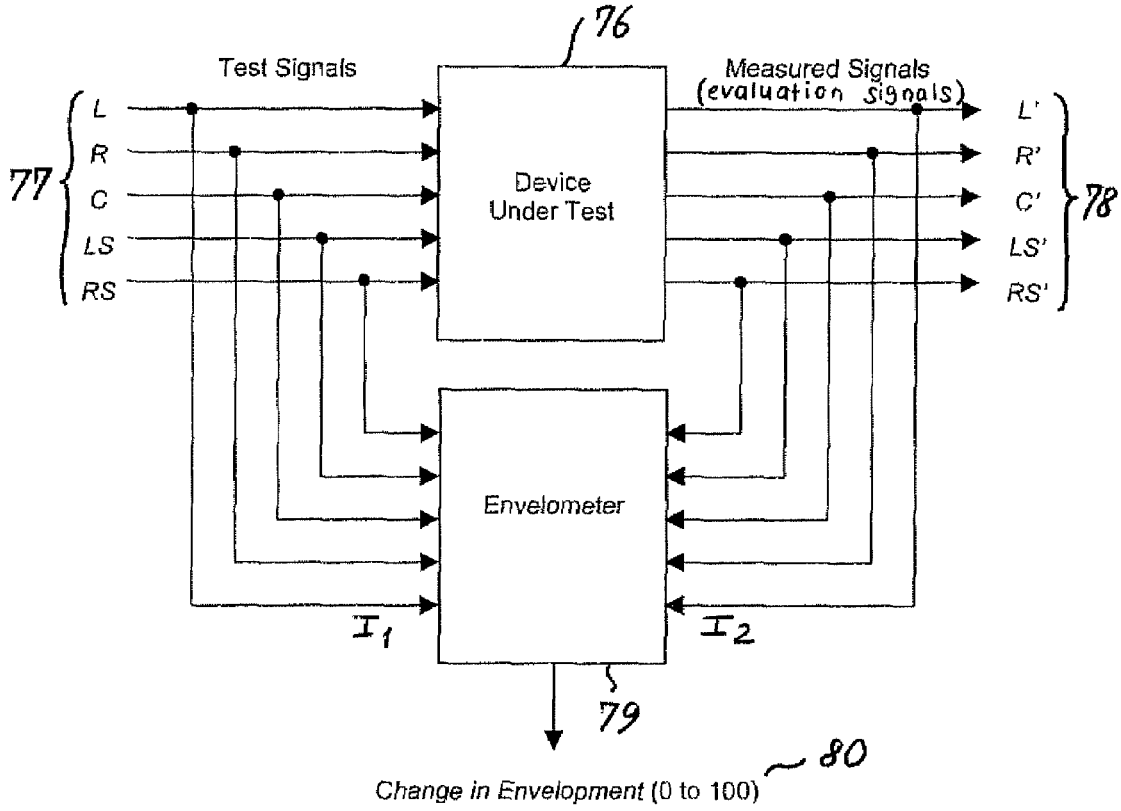

FIG. 14. A double-ended version of an envelometer according to the invention.

Figure 15:
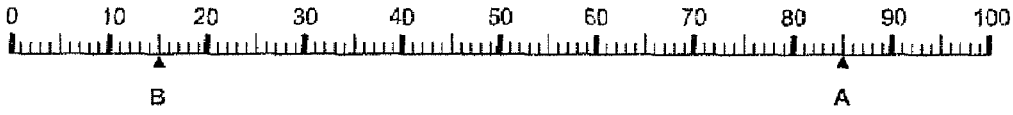

FIG. 15. An example of an envelopment scale used in connection with the envelometer according to the present invention.

FIG. 16. Uni-dimensional envelopment scale.

FIG. 17. Semantic differential envelopment scale.

FIG. 18. Likert scale.

Figure 19:
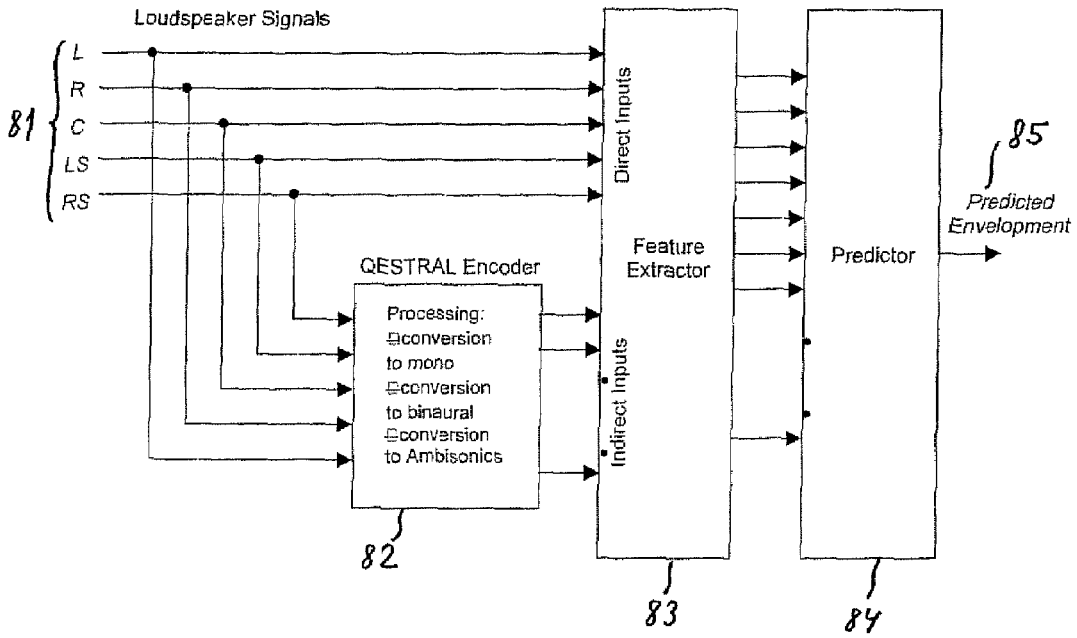

FIG. 19. A schematic representation of the internal structure of an envelometer according to an embodiment of the invention.

Figure 20:
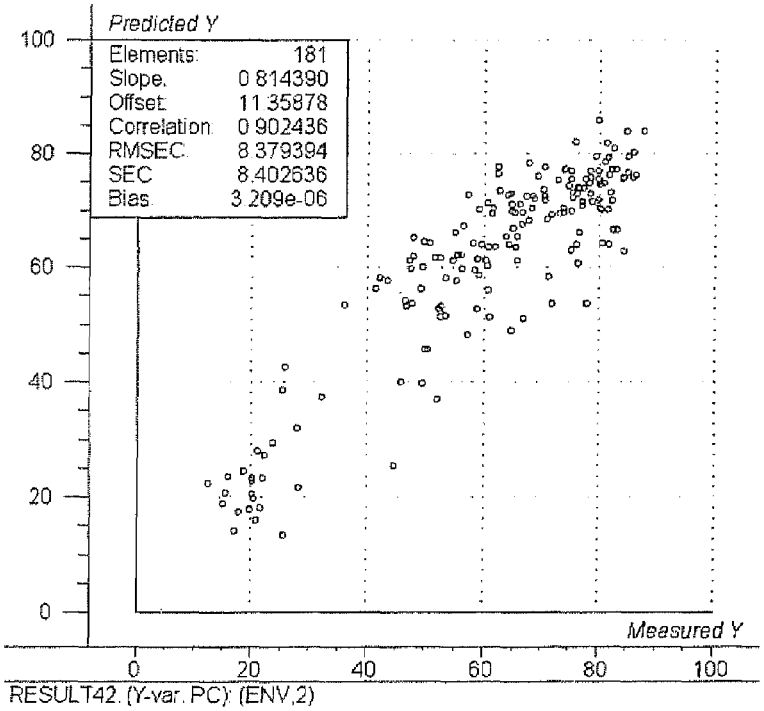

FIG. 20. Results of calibration (regression analysis of predicted versus measured envelopment).

Figure 21:
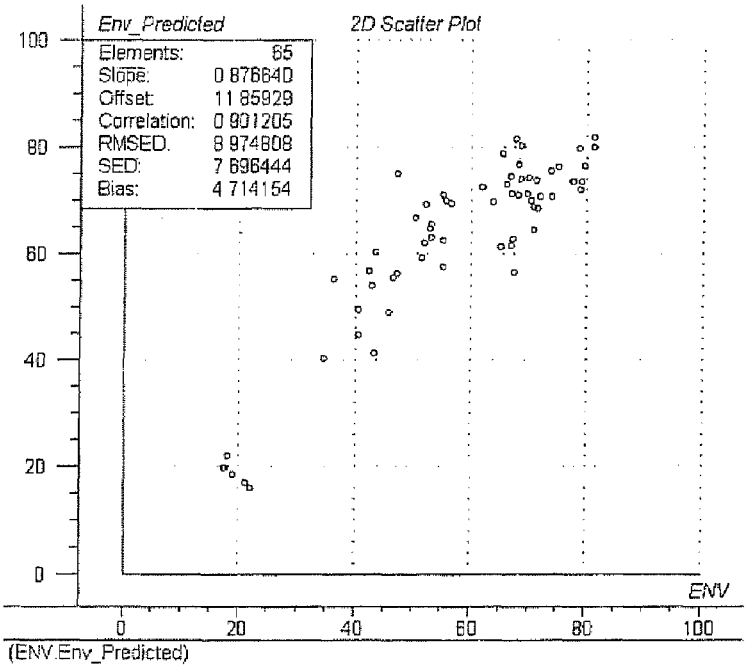

FIG. 21. Results of the validation (regression analysis of predicted versus measured envelopment, i.e. envelopment assessed by listening tests on human listeners).

Figure 22:
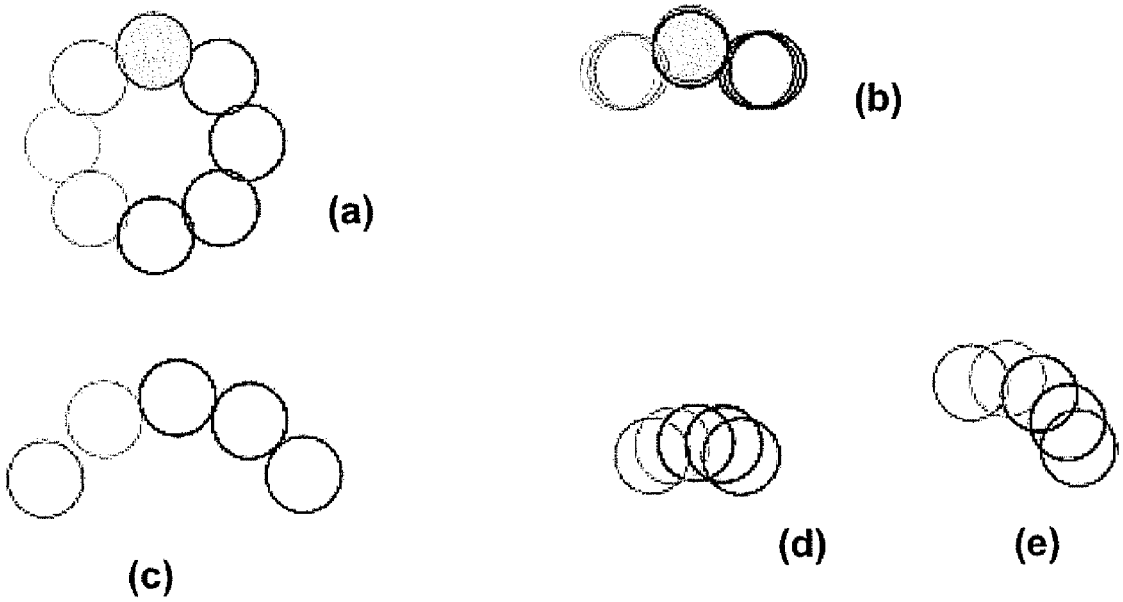

FIG. 22. Examples of (F) distortions. The circles represent individually perceivable sound sources in a spatial audio scene. In the upper example (a) and (b), representing the likely effect of downmixing from multichannel surround to two-channel stereo, sources that were arranged in a circle around the listener in the original version (a) have been mapped onto an angle in front of the listener (b). In the lower example (c), (d) and (e), representing front image narrowing or skew, sources that were panned across a wide subtended angle (c) have been compressed into a narrower subtended angle (d) or skewed to the right and compressed (e).

Figure 23:
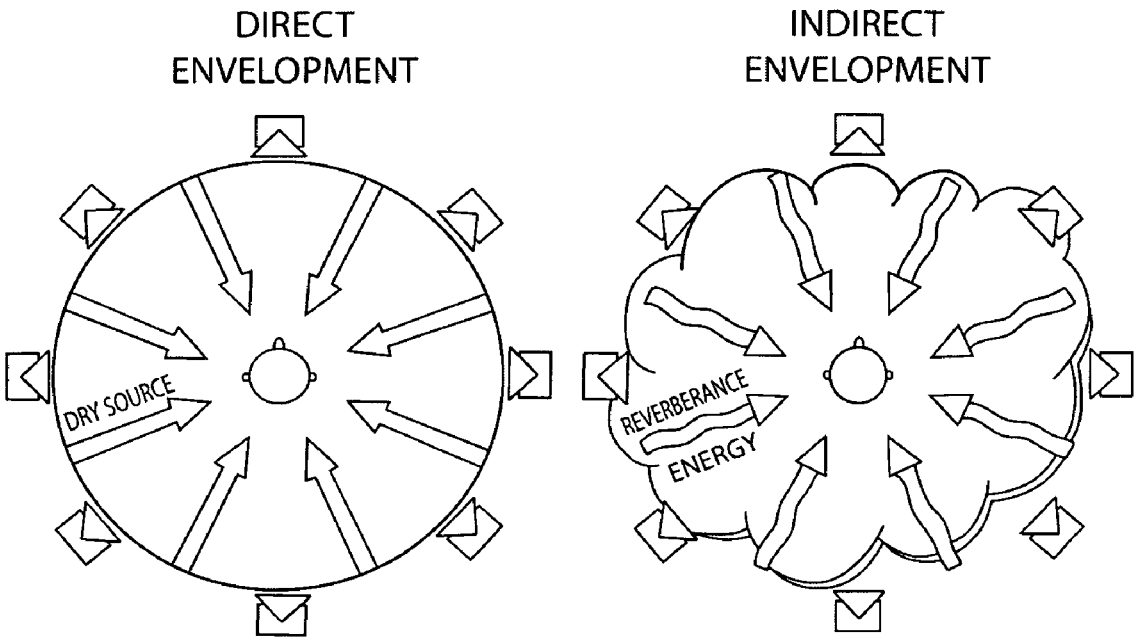

FIG. 23. Graphical representation of the concepts of direct and indirect envelopment.

Figure 24:
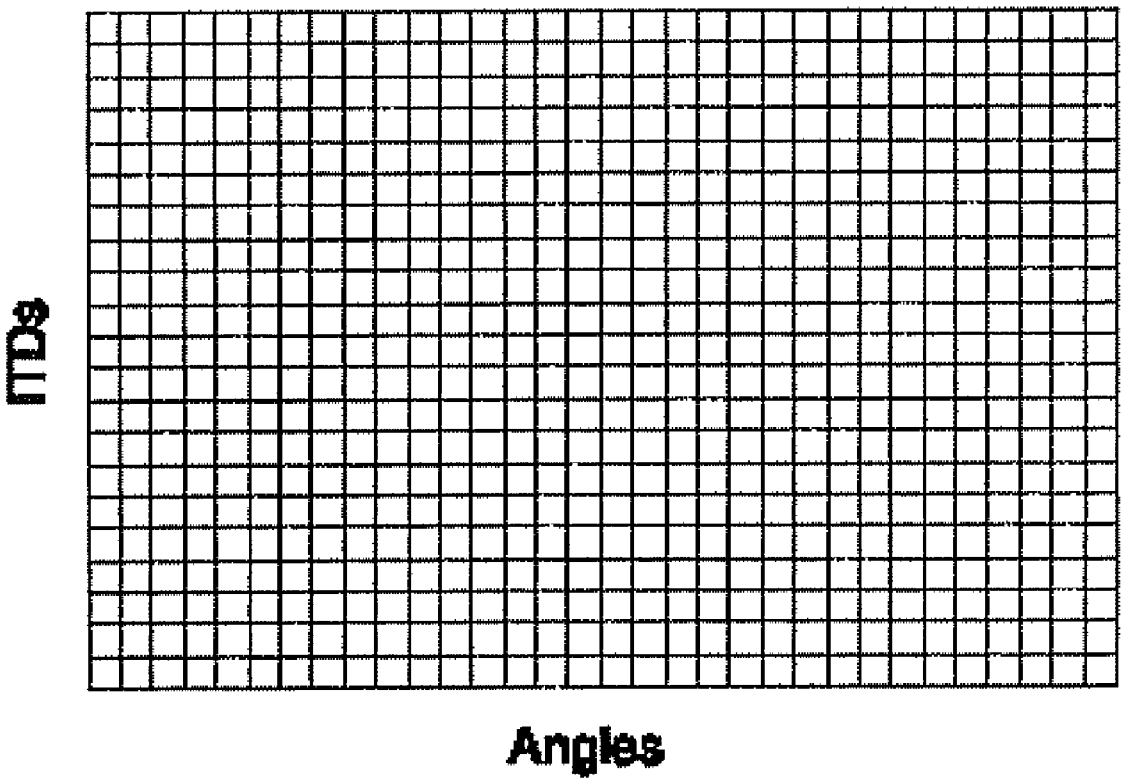

FIG. 24. A template for an ITD loot-up table used in connection with the description in APPENDIX 1 where each cell in the table corresponds to a combination of an angle and an interaural time difference (ITD); each row in the table corresponds to an ITD and each column corresponds to an angle.

DETAILED DESCRIPTION OF THE INVENTION

Referring to FIG. 1*a* there is shown a first embodiment of the invention in the form of un-intrusive evaluation using audio programme material 1 as a source, although the input to the DUT 2 (i.e. the Device Under Test, which means any combination of the recording, processing, rendering or reproducing elements of an audio system) according to another option may be customised/dedicated test signals for instance aiming at highlighting specific auditory attributes or spanning the complete range of auditory perception. The output signal from the DUT 2 may be subjected to an encoding procedure termed QESTRAL encode 5 in order to obtain a format suitable for the subsequent processing by the invention. This processing comprises application of suitable metrics 6 as described previously in the summary of the invention. Examples of such metrics are given in subsequent paragraphs of the present specification. Finally, after deriving a physical measure of the auditory scene—or specific attributes hereof—a prediction of the perceived spatial quality, either as a holistic quantity or in form of one or more specific attributes hereof, is derived as indicated by reference numeral 7.

Referring to FIG. 1*b* there is shown a second embodiment of the invention in the form of intrusive evaluation basically comprising comparison between signals 3 processed by the DUT 2 and a reference signal 4, i.e. a signal that has not been processed by the DUT. Also in this embodiment the input signals 1 may be either audio programme material or customised/dedicated signals as mentioned in connection with FIG. 1*a* above.

As mentioned the abbreviation DUT represents 'Device Under Test', which refers broadly to any combination of the recording, processing, rendering or reproducing elements of an audio system and also any relevant processing method implemented by use of such elements (this can include loudspeaker format and layout) and QESTRAL encode 5 refers to a method for encoding spatial audio signals into an internal representation format suitable for evaluation by the quality model of the present invention (this may include room acoustics simulation, loudspeaker-to-listener transfer functions, and/or sound field capture by one or more probes or microphones). As mentioned previously test signals of a generic nature, i.e. signals that can be used to evaluate the spatial quality of any relevant DUT, may be provided by the test source 1. In order to use these signals in a special application a transcoding 8 may be necessary. An example would be the transcoding required in order to be able to use a test signal comprising a universal directional encoding for instance in the form of high order spherical harmonics for driving a standard 5.1 surround sound loudspeaker set-up. There may of course be instances where no transcoding is required. After QESTRAL encoding (if needed) suitable metrics 6 derive the physical measures $m_1$ and $m_2$ characterising the spatial quality (or specific attributes hereof) and these measures are compared in comparison means 9 and the result of this comparison c is translated to a predicted spatial fidelity difference grade 10 referring to the difference grade between the reference version of the signals and the version of these signals that has been processed through the DUT. As an addition to the comparison carried out by the system shown in FIG. 1*b* the physical measure m2 may be by used to carry out an absolute evaluation (reference numeral 7) corresponding to the FIG. 1*a*.

In one alternative of the present invention the spatial quality of one or more DUTs are evaluated using real acoustical signals. In another alternative the acoustical environment and transducers are simulated using digital signal processing. In still another alternative a combination of the two approaches is employed (simulated reproduction of the reference version, acoustical reproduction of the evaluation version).

Referring to FIG. 2*a* there is shown an illustrative example of the general concept of a system according the second embodiment of the invention using the intrusive approach as described in connection with FIG. 1*b* above. In the shown example a comparison between the predicted auditory spatial quality of a reference system and of (in this specific example) a more simple reproduction system is carried out.

The reference system consists of a standard 5.1 surround sound reproduction system comprising a set-up of five loudspeakers 17 placed around a listening position in a well-known manner. The test signals 1 applied are presented to the loudspeakers 17 in the appropriate 5.1 surround sound format (through suitable power amplifiers, not shown in the figure) as symbolically indicated by the block "reference rendering" 14. The original test signals 1 may, if desired, be authored as indicated by reference numeral 8'. The sound signals emitted by the loudspeakers 17 generate an original sound field 15 that can be perceived by real listeners or recorded by means of an artificial listener (artificial head, head and torso simulator etc.) 16. The artificial listener 16 is provided with pinna replicas and microphones in a well-known manner and can be characterised by left and right head-related transfer functions (HRTF) and/or corresponding head-related impulse responses (HRIR). The sound signals (a left and a right signal) picked up by the microphones in the artificial listener 16 are provided (symbolized by reference numeral 18) to means 6' that utilises appropriate metrics to derive a physical measure 19 that in an appropriate manner characterises the auditory spatial characteristics or attributes of the sound field 15. These physical measures 19 are provided to comparing means 9.

The system to be evaluated by this embodiment of the present invention is a virtual 2-channel surround system comprising only two front loudspeakers 25 in stead of the five-loudspeaker set-up of the reference system. The total "device under test" DUT 2 consists in the example of a processing/codec/transmission path 21 and a reproduction rendering 22 providing the final output signals to the loudspeakers 25. The loudspeakers generate a sound field 24 that is an altered version of the original sound field 15 of the reference system. This sound field is recorded by an artificial listener 16 and the output signals (left and right ear signals) from the artificial listener are provided to means 6" that utilises appropriate metrics to derive a physical measure 20 that in an appropriate manner characterises the auditory spatial characteristics (in this case the same characteristics or attributes as the means 6') of the sound field 24. These physical measures 20 are provided to comparing means 9 where they are compared with the physical measures 19 provided by the metric means 6' in the reference system.

The result of the comparison carried out in the comparison means 9 are provided as designated by reference numeral 28.

The result 28 of the comparison of the two physical measures 19 and 20 is itself a physical measure and this physical measure must be translated to a predicted subjective (i.e. perceived) difference 10 that can for instance be described by means of suitable scales as described in more detail in following paragraphs of this specification.

Referring to FIG. 2*b* there is shown a further example of the general concept of a system according to the second embodiment of the invention comprising prediction of separate attribute differences related to perceived auditory spatial quality and also prediction of perceived auditory spatial quality difference as a holistic quantity. It should be noted, however, that—as mentioned previously—prediction of overall (holistic) spatial perception and perception difference (reference numeral 40 in FIG. 2*b*) could be based on metrics that are not related to specific psychoacoustic attributes or attribute differences. The exemplifying system shown in FIG. 2*b* can be regarded as an extension of the system shown in FIG. 2*a* and can be used—apart from predicting overall spatial perception difference 40 (between the reference system and the DUT)—to predict different specific attribute differences, such as, but not limited to, localisation 32, envelopment 34, source width 36 and spatial depth or distance perception 38. Different statistical regression models, look-up tables or equivalent means are used for the different attributes and calibrated via results from different, relevant listening tests 33, 35, 37, 39 and 41. The overall spatial perception quality difference 40 may even be predicted with more or less accuracy based on the individual predicted subjective differences (for instance individual ratings on appropriate scales) as symbolically indicated by L, E, SW and SD in FIG. 2*b*.

Referring to FIG. 3*a* there is shown a schematic representation of the principle of the invention, illustrating a set-up where a set of raw data are provided to a metric means that based on the raw data provides a higher-level representation relating to a given perceptual attribute (holistic or specific), where this higher-level representation is subsequently provided to predictor means that are calibrated on the basis of listening tests and which predictor means provides a prediction of the given perceptual attribute (holistic or specific). The shown illustrative block diagrams relate specifically to an absolute (un-intrusive) evaluation according to the invention, but corresponding diagrams specifically illustrating relative (intrusive) evaluation could also be given.

FIG. 3*a* illustrates un-intrusive prediction of perceived envelopment, but it is understood that envelopment is only an example of an auditory perceptual attribute that could be predicted by the invention and that other, specific attributes as well as overall spatial audio quality, as a holistic quantity could be predicted according to the invention, both intrusively and un-intrusively. Reference numeral 43 indicates raw physical measurements or quantities, for instance sound pressure measurements in an actual sound field or audio signals from a DVD or from a signal processing algorithm. The corresponding signals, measurements or quantities $I_i$ are provided to a metric for providing an objective measure M relating to the attribute (in this example) "envelopment", thus at the output of the metric is provided a higher level objective measure derived from the raw measurements, signals or quantities. This objective measure M is provided to a prediction model 46, which may for instance be implemented as a regression model, lookup table, or an artificial neural network, which prediction model has been calibrated by means of suitable listening tests on real listeners as symbolically indicated by reference numeral 45. The prediction model 46 "translates" the objective measure M into a subjective perceptual measure 47, in the shown example of the envelopment as it would be perceived by human listeners. This subjective perceptual measure 47 can for instance be characterised by a rating on a suitable scale as indicated by 47' in the figure.

Referring to FIG. 3*b* there is shown a somewhat more sophisticated version of the basic principle according to the invention. The illustrative representation of FIG. 3(*b*) emphasises among other things, that in order to arrive at the desired final prediction it may be necessary or expedient to apply the raw data 43 (the signals $I_1, \ldots I_5$) not only to one specific metric 42 as shown in FIG. 3(*a*) but to a plurality of metrics 42', 42", 42'" . . . , where the individual metrics are designed either for deriving an objective measure of a specific auditory attribute or simply for deriving an objective measure that is needed or desirable for the subsequent prediction 46', but which is not an in itself an objective measure relating directly to an auditory attribute as such. The block diagram in FIG. 3(*b*) furthermore indicates that although one or more of the said metrics may be provided with the full set of raw data 43 (the signals, measurements or quantities $I_1, \ldots I_5$) one or more metrics may be provided with only one or more sub-sets of raw data, as indicated by the three dashed arrows.

FIG. 3*c* shows schematically the relationship between raw data (physical signals), low-level metrics, high-level metrics and objective measures. According to the invention the objective measures that are subsequently provided to the prediction means may be derived from the raw data or measurements (physical signals) 43 through a "hierarchy" of metrics. Thus, as exemplified in FIG. 3*c* low-level metrics 42L may be derived directly from the raw data 43 and higher-level metrics 42H may derive the final objective measure M from the set of low-level metrics 42L.

The objective measures provided by the plurality of metrics are subsequently provided to a prediction model 46' that has been calibrated appropriately by means of listening tests as described above and which prediction model 46' (which as in FIG. 3(*a*) may be a regression model, an artificial neural network etc.) translates the received set of objective measures from the metrics to the final, desired predicted auditory quantity. This predicted quantity may be either specific auditory attributes (such as envelopment, localisation, etc.) or an overall (holistic) quantity that for instance could be overall perceived spatial quality.

FEATURES OF THE INVENTION

Reference Versions, Evaluation Versions and Anchor Versions of Spatial Audio Signals When auditioned by a human listener, one or more audio signals reproduced through one or more transducers give rise to a perceived spatial audio scene, whose features are determined by the content of the audio signal(s) and any inter-channel relationships between those audio signals (e.g. inter-channel time and amplitude relationships). For the sake of clarity, the term 'version' is used to describe a particular instance of such a reproduction, having a specific channel format, transducer arrangement and listening environment, giving rise to the perception of a certain spatial quality. It is not necessary for any versions that might be compared by the system to have the same channel format, transducer arrangement or listening environment. The term 'reference version' is used to describe a reference instance of such, used as a basis for the comparison of other versions. The term 'evaluation version' is used to describe a version whose spatial quality is to be evaluated by the system, device and method according to the present invention described here. This 'evaluation version' may have been subject to any recording, processing, reproducing, rendering or acoustical modification process that is capable of affecting the perceived spatial quality.

In the case of single-ended embodiments of the system, device and method of the present invention, no reference version is available, hence any prediction of spatial quality is made on the basis of metrics derived from the evaluation version alone. In the case of double-ended embodiments of the system, device and method according to the invention, it is assumed that the evaluation version is an altered version of the reference version, and a comparison is made between metrics derived from the evaluation version and metrics derived from the reference version (as exemplified by FIGS. 1*b*, 2*a* and 2*b*)

An 'anchor version' is a version of the reference signal, or any other explicitly defined signal or group of signals, that is aligned with a point on the quality scale to act as a scale anchor. Anchor versions can be used to calibrate quality predictions with relation to defined auditory stimuli.

Definition of Spatial Quality

Spatial quality, in the present context, means a global or holistic perceptual quality, the evaluation of which takes into account any and all of the spatial attributes of the reproduced sound, including, but not limited to:

- Location of individual sources, which may include elevation and front/back disambiguation.
- Rotation or skew of the entire spatial scene.
- Width of sources or groups of sources.
- Focus, precision of location, or diffuseness of sources.
- Stability or movement of sources.
- Distance and depth.
- Envelopment (the degree to which a listener feels immersed by sound).
- Continuity ("holes" or gaps in the spatial scene).
- Spaciousness (the perceived size of the background spatial scene, usually implied by reverberation, reflections or other diffuse cues).
- Other spatial effects (e.g. spatial effects of phase alteration or modulation).

Spatial quality can be evaluated by comparing the spatial quality of an evaluation version to a reference version (double-ended or intrusive method), or using only one or more evaluation versions (single-ended or unintrusive method).

In one embodiment of the invention the spatial quality rating can include a component that accounts for the subjective hedonic effect of such spatial attributes on a defined group of human subjects within a given application context. This subjective hedonic effect can include factors such as the appropriateness, unpleasantness or annoyance of any spatial distortions or changes in the evaluation version compared with the reference version.

When using the single-ended method, the global spatial quality grade is to some extent arbitrary, as there is no reference version available for comparison. In this case spatial quality is defined in terms of hedonic preference for one version over another, taking into account the application context, target population and programme content. Different databases of listening test results and alternative calibrations of the statistical regression model, look-up table or equivalent means may be required if it is desired to obtain accurate results for specific scenarios.

However, also when using the single-ended method, one manifestation of the system and method enables selected sub-attributes, contributing to the global spatial quality grade, to be predicted in a single-ended fashion. One example of this is the 'envelometer' which predicts the envelopment of arbitrary spatial audio signals, calibrated against explicit auditory anchors (see the following detailed description of an embodiment of an envelometer according to the present invention). Another example of this is the source location predictor (an embodiment of which is also described in detail in the following).

The spatial quality of the evaluation version can be presented in the form either of a numerical grade or rank order position among a group of versions, although other modes of descriptions may also be used.

Scales

A number of embodiments of the system, device and method according to the invention are possible, each of which predicts spatial quality on an appropriate scale, calibrated against a database of responses derived from experiments involving human listeners. The following are examples of scales that can be employed, which in a basic form of the system can give rise to ordinal grades that can be placed in rank order of quality, or in a more advanced form of the system can be numerical grades on an interval scale:

(1) A spatial quality scale. This is appropriate for use either with or without a reference version. If a reference version is available its spatial quality can be aligned with a specific point on the scale, such as the middle. Evaluation versions are graded anywhere on the scale, depending on the prediction of their perceived spatial quality. Evaluation versions can be graded either higher or lower than any reference version. If an evaluation version is graded above any reference version it is taken to mean that this represents an improvement in spatial quality compared to the reference.

(2) A spatial quality impairment scale. This is a special case of (1) appropriate for use only where a reference version, representing a correct original version, is available for comparison. Here the highest grade on the scale is deemed to have the same spatial quality as that of the reference version. Lower grades on the scale have lower spatial quality than that of the reference version. All evaluation versions have to be graded either the same as, or lower than, the reference version. It is assumed that any spatial alteration of the reference signal must be regarded as an impairment and should be graded with lower spatial quality.

Scale Anchoring

As there is no absolute meaning to spatial quality, and no known reference point for the highest and lowest spatial quality possible in absolute terms, the range of scales employed must be defined operationally within the scope of the present invention. A number of embodiments are possible, requiring alternative calibrations of for instance a statistical regression model, look-up table or equivalent means used to predict the spatial quality, and which may require alternative metrics and databases of listening test results from human subjects if the most accurate results are to be obtained. In all the embodiments described below the minimum requirement is that the polarity of the scale is indicated—in other words, which direction represents higher or lower quality:

1) An unlabelled scale without explicit anchors. Here the evaluation versions are graded in relation to each other, making it possible to determine their relative spatial quality, but with no indication of their spatial quality in relation to verbal or auditory anchor points.

2) An unlabelled scale with explicit auditory anchors. Here the evaluation versions are graded against one or more explicit auditory anchors. The auditory anchors are aligned with specific points on the scale that may correspond to desired or meaningful levels of spatial quality. The auditory anchors define specific levels of spatial quality inherent in the anchor versions. In the case of the spatial impairment scale, the only explicit anchor is at the top of the scale and is the reference version.

3) An unlabelled scale with reference and hidden auditory anchors. Here the evaluation versions are graded in relation to the reference version. Hidden among the versions are one or more anchor stimuli having known spatial characteristics. This can be used during the calibration of the system to compensate for different uses of the scale across different calibration experiments, provided that the same anchor stimuli are used on each calibration occasion.

4) Any of the above scales can be used together with verbal labels that assign specific meanings to marked points on the scale. Examples of such labels are derived from ITU-R standards BS.1116 and 1534. In the case of impairment scales these can be marked from top to bottom at equal intervals: imperceptible (top of scale); perceptible but not annoying; slightly annoying; annoying; very annoying (bottom of scale). In the case of quality scales the interval regions on the scale can be marked excellent (highest interval), good, fair, poor, bad (lowest interval). In all cases these scale labels are intended to represent equal increments of quality on a linear scale. It should be noted that such verbal labels are subject to biases depending on the range of qualities inherent in the stimuli evaluated, language translation biases, and differences in interpretation between listeners. For this reason it is recommended that labelled scales are only used when a verbally defined meaning for a certain quality level is mandatory.

Input Signals

In one embodiment of the invention the input signals to the DUT are any form of ecologically valid spatial audio programme material.

In another embodiment of the invention the input signals to the DUT are special test signals, having known spatial characteristics.

The system, device and method according to the invention includes descriptions of ecologically valid, or programme like test signals, and sequences thereof, that have properties such that when applied to the DUT and subsequently measured by the algorithms employed by the system, lead to predictions of perceived spatial quality that closely match those given by human listeners when listening to typical programme material that has been processed through the same DUT. These test signals are designed in a generic fashion in such a way that they stress the spatial performance of the DUT across a range of relevant spatial attributes.

The selection of appropriate test signals and the metrics used for their measurement depends on the chosen application area and context for the spatial quality prediction. This is because not all spatial attributes are equally important in all application areas or contexts. In one embodiment of the invention the test signals and sequence thereof can be selected from one of a number of stored possibilities, so as to choose the one that most closely resembles the application area of the test in question. An example of this is that the set of test signals and metrics required to evaluate spatial quality of 3D flight simulators would differ from the set required to evaluate home cinema systems.

Other examples of sets of test signals and metrics include those suitable for the prediction of typical changes in spatial quality arising from, for example (but not restricted to): audio codecs, downmixers, alternative rendering formats/algorithms, non-ideal or alternative loudspeaker layouts or major changes in room acoustics.

In one embodiment of the invention the test signals are created in a universal spatial rendering format of high directional accuracy (e.g. high order ambisonics). These are then transcoded to the channel format of the reference and/or evaluation versions so that they can be used. In this way the test signals are described in a fashion that is independent of the ultimate rendering format and can be transcoded to any desired loudspeaker or headphone format.

In another embodiment of the invention, the test signals are created in a specific channel format corresponding to the format of the system under test. An example of this is the ITU-R BS.775 3-2 stereo format. Other examples include the ITU 5-2 stereo format, the 2-0 loudspeaker stereo format and the two channel binaural format. In the last case the test signals are created using an appropriate set of two-channel head-related transfer functions that enable the creation of test signals with controlled interaural differences. Such test signals are appropriate for binaural headphone system or crosstalk cancelled loudspeaker systems that are designed for binaural sources.

Real or Simulated Room Acoustics

In one embodiment of the invention the spatial quality of one or more DUTs is evaluated using real acoustical signals reproduced in real rooms.

In another embodiment the acoustical environment and/or transducers are simulated using digital signal processing.

In another embodiment a combination of the two approaches is employed (e.g. simulated reproduction of the reference version, acoustical reproduction of the evaluation version). In this embodiment, for example, a stored and simulated reference version could be compared in the field against a number of real evaluation versions.

The DUT may include the transducers and/or room acoustics (e.g. if one is comparing different loudspeaker layouts or the effects of different rooms).

The room impulse responses used to simulate reproduction of loudspeaker signals in various listening environments may be obtained from a commercial acoustical modeling package, using room models built specifically for the purposes of capturing impulse responses needed for the loudspeaker layouts and listener positions needed for the purposes of this model.

Oestral Encoding

The process of QESTRAL encoding is the translation of one or more audio channels of the reference or evaluation versions into an internal representation format suitable for analysis by the system's measurement algorithms and metrics. Such encoding involves one or more of the following processes, depending on whether the DUT includes the transducers and/or room acoustics:

(1) Loudspeaker or headphone reproduction, or simulation thereof, at one or more locations.

(2) Anechoic or reverberant reproduction, or simulation thereof, with one or more rooms.

(3) Pickup by probe transducers (real or simulated), at one or more locations, with one or more probes.

(4) Direct coupling of the audio channel signals from the DUT, if the DUT is an audio signal storage, transmission or processing device, (i.e. omitting the influence of transducers, acoustical environment and head-related transfer functions).

Depending on the set of metrics to be employed, according to the mode of operation of the system, device and method according to the invention, one or more of these encoding processes will be employed.

Examples of probe transducers include omnidirectional and directional (e.g. cardioid or bi-directional) microphones, Ambisonic 'sound field' microphone of any order, wavefield capture or sampling arrays, directional microphone arrays, binaural microphones or dummy head and torso simulator.

In one example, given for illustration purposes, the DUT is a five channel perceptual audio codec and it is desired to determine the spatial quality in relation to an unimpaired five channel reference version. In such a case the evaluation and reference versions are five channel digital audio signals. QESTRAL encoding then involves the simulated or real reproduction of those signals over loudspeakers, either in anechoic or reverberant room conditions, finally the capture of the spatial sound field at one or more locations by means of one or more simulated or real pickup transducers or probes. This requires processes (1) (2) and (3) above. Alternatively, in another embodiment of the invention, results of limited applicability could be obtained by means of process (4) alone, assuming that appropriate metrics and listening test results can be obtained.

In another example the DUT is a loudspeaker array and it is desired to determine the spatial quality difference between a reference loudspeaker array and a modified array that has different loudspeaker locations, in the same listening room. In such a case the evaluation and reference versions are real or simulated loudspeaker signals reproduced in a real or simulated listening room. QESTRAL encoding then involves only process (3).

Listening Position

In one embodiment of the invention the spatial quality is predicted at a single listening location.

In another embodiment the spatial quality is predicted at a number of locations throughout the listening area. These results can either be averaged or presented as separate values. This enables the drawing of a quality map or contour plot showing how spatial quality changes over the listening area.

System Calibration

The system, device or method according to the invention is calibrated using ratings of spatial quality given on scales as described above, provided by one or more panels of human listeners. A database of such results can be obtained for every context, programme type and/or application area in which the system, device and method according to the invention is to be applied. It may also be desirable to obtain databases that can be used for different populations of listeners (e.g. audio experts, pilots, game players) and for scenarios with and without different forms of picture. For example, it may be necessary to obtain a database of quality ratings in the context of home cinema systems (application area), movie programme material (programme content) and expert audio listeners (population). Another database could relate to flight simulators (application area), battle sound effects and approaching missiles (programme content), and pilots (population).

In the case of each database, a range of programme material is chosen that, in the opinion of experts in the field, and a systematic evaluation of the spatial attributes considered important in that field, is representative of the genre. This programme material is subjected to a range of spatial audio processes, based on the known characteristics of the DUTs that are to be tested, appropriate to the field, giving rise to a range of spatial quality variations. It is important that all of the relevant spatial attributes are considered and that as many as possible of the spatial processes likely to be encountered in practical situations are employed. Greater accuracy of prediction is obtained from the system as more, and more relevant, examples are employed in the calibration process. It is important that the range of spatial qualities presented in the calibration phase spans the range of spatial qualities that are to be predicted by the system, and does so in a well distributed and uniform manner across the scale employed.

Calibration is achieved by listening tests which should be carried out using controlled blind listening test procedures, with clear instructions to subjects about the task, definition of spatial audio quality, meaning of the scale and range of stimuli. Training and familiarization can be used to improve the reliability of such results. Multiple stimulus comparison methods enable fast and reliable generation of such quality data.

Metrics

The systems, devices and methods according to the invention relies on psychoacoustically informed metrics, derived from measurements of the audio signals (that may have been QESTRAL-encoded) and that, in an appropriately weighted linear or non-linear combination, enable predictions of spatial quality.

As noted above, it is possible for the input signals to the QESTRAL model to be either ecologically valid programme material, or, in another embodiment, specially designed test signals with known spatial characteristics. The metrics employed in each case may differ, as it is possible to employ more detailed analysis of changes in the spatial sound field when the characteristics of the signals to be evaluated are known and controllable. For example, known input source locations to the DUT could be compared against measured output locations in the latter scenario. In the case where programme material is used as a source a more limited range of metrics and analysis is likely to be possible.

Regression Model

The systems, devices and methods according to the invention incorporates a statistical regression model, look-up table or tables or equivalent means of weighting and combining the results of the above metrics (for instance relating to the prediction of the perception of different auditory space-related attributes) so as to arrive at an overall prediction of spatial quality or fidelity. Such a model may scale and combine some or all of the metrics in an appropriate linear or non-linear combination, in such a way as to minimise the error between actual (listening test database) and predicted values of spatial quality.

In one embodiment of the invention a generic regression model is employed that aims to predict an average value for spatial audio quality of the evaluation version, based on a range of listening test databases derived from different application areas and contexts.

In another embodiment individual regression models are employed for each application area, context, programme genre and/or listener population. This enables more accurate results to be obtained, tailored to the precise circumstances of the test.

There follows an example of a regression model employed to predict the spatial quality of a number of evaluation versions when compared to a reference version.

Test Signals, Metrics and a Regression Model for Predicting Spatial Quality as a Holistic Quantity The following is an example of the use of selected metrics, together with special test signals, also a regression model calibrated using listening test scores derived from human listeners, to measure the reduction in spatial quality of 5-channel ITU BS.775 programme material compared with a reference reproduction, when subjected to a range of processes modifying the audio signals (representative of different DUTs), including downmixing, changes in loudspeaker location, distortions of source locations, and changes in inter-channel correlation.

Outline of the Method

In this example, special test signals are used as inputs to the model, one of which enables the easy evaluation of changes in source locations. These test signals in their reference form are passed through the DUTs leading to spatially impaired evaluation versions. The reference and evaluation versions of the test signals are then used as inputs to the selected metrics as described below. The outputs of the metrics are used as predictor variables in a regression model. A panel of human listeners audition a wide range of different types of real 5-channel audio programme material, comparing a reference version with an impaired version processed by the same DUTs. Spatial quality subjective grades are thereby obtained. This generates a database of listening test scores, which is used to calibrate the regression model. The calibration process aims to minimize the error in predicted scores, weighting the predictor variables so as to arrive at a suitable mathematical relationship between the predictor variables and the listening test scores. In this example, a linear partial-least-squares regression (PLS-R) model is used, which helps to ameliorate the effects of multi-colinearity between predictor variables.

Special Test Signals

Test signal 1: a decorrelated pink noise played through all five channels simultaneously.

Test signal 2: thirty-six pink noise bursts, pairwise-constant-power-panned around the five loudspeakers from 0° to 360° in 10° increments. Each noise burst lasts one second.

Metrics

As shown in Table 1, one set of metrics is used with test signal 1, and another with test signal 2. In the case of the metrics used with test signal 1, these are calculated as difference values between the reference condition and the evaluation condition. These metrics are intended to respond to changes in envelopment and spaciousness caused by the DUT. In the case of the metrics used with test signal 2, the noise bursts are input to the localisation model, resulting in thirty-six source location angles in the range 0° to 360°. Three higher-level metrics that transform a set of thirty-six angles into a single value are then used. The metrics used on the second test signal are intended to respond to changes in source localisation caused by the DUT.

TABLE 1

The features used in the regression model.

| Test Signal | Feature Name | Description |
|---|---|---|
| Test signal 1: 5 channel decorrelated pink noise | IACC0 | The IACC calculated with the 0° head orientation. This value is computed as the mean IACC value across 22 frequency bands (150 Hz-10 kHz). |
| | IACC90 | The IACC calculated with the 90° head orientation. This value is computed as the mean IACC value across 22 frequency bands (150 Hz-10 kHz). |
| | IACC0 * IACC90 | The product of the IACC0 and IACC90 values above. |
| | CardKLT | The contribution in percent of the first eigenvector from a Karhunen-Loeve Transform (KLT) decomposition of four cardioid microphones placed at the listening position and facing in the following directions: 0°, 90°, 180° and 270°. |

TABLE 1-continued

The features used in the regression model.

| Test Signal | Feature Name | Description |
|---|---|---|
| Test signal 2: Pink noise bursts pairwise constant power panned from 0° to 360° in 10° increments | Mean_Ang | The mean absolute change to the angles calculated using the directional localisation model from the 36 noise bursts. |
| | Max_Ang | The maximum absolute change to the angles calculated using the directional localisation model from the 36 noise bursts. |
| | Hull | Angles for each of the 36 noise bursts were calculated using the directional localisation model. These angles were then plotted on the circumference of a unit circle. The smallest polygon containing all these points (the convex hull) was determined. The final value of the metric is the area inside the convex hull. |

Regression Model

The coefficients of an example calibrated regression model, showing raw and standardised (weighted) coefficients are shown in Table 2.

TABLE 2

Coefficients of the regression model.

| Metric | Raw (B) | Weighted (BW) |
|---|---|---|
| IACC0 | 37.683 | 0.150 |
| IACC90 | 52.250 | 0.160 |
| IACC0 * IACC90 | 29.489 | 0.160 |
| CardKLT | 0.290 | 0.148 |
| Mean_ang | 0.149 | 0.150 |
| Max_ang | 5.540e−02 | 0.110 |

TABLE 2-continued

Coefficients of the regression model.

| Metric | Raw (B) | Weighted (BW) |
|---|---|---|
| Hull | −4.112 | −0.146 |
| constant | 105.567497 | 3.003783 |

Example of Prediction Accuracy

An example of the prediction of listening test scores using this regression model are shown in FIG. 4. The correlation of the regression is 0.93 and the root mean square error of calibration is 12.8%. The different stimuli are predicted in the correct rank order of spatial quality.

There follows a list of examples of high level metrics (described here as 'features') that according to the invention can be used in the prediction of spatial quality or individual attributes thereof:

TABLE 3

| Type | Feature Name | Description |
|---|---|---|
| Based on Karhunen-Loeve Transform (KLT) | klt_var1 | Variance of the first eigen vector of a KLT of the raw audio signal channel data, normalised to 100%. This is a measure of inter-channel correlation between loudspeaker signals. |
| | klt_centroid_n | Centroid of KLT variance. This is a measure of how many channels are active in the KLT domain. |
| | KLTAmax_Area90 | KLT can be used to calculate how the dominant angle of sound incidence fluctuates in time. For mono sound sources the angle fluctuates around 0. For enveloping sources it may vary between ±180 degrees. The feature was calculated using the area of coverage. Area based on dominant angles (threshold = 0.90) |
| | CardKLT | The contribution in percent of the first eigenvector from a Karhunen-Loeve Transform (KLT) decomposition of four cardioid microphones placed at the listening position and facing in the following directions: 0°, 90°, 180° and 270°. |
| Energy-based | BFR | Back-to-Front energy ratio (comparing total energy radiated in the front hemisphere of the sound field with that in the rear hemisphere) |
| | LErms_n | Lateral energy as measured by a sideways-facing (−90° and +90°) figure-eight microphone |
| | Total energy | Total energy measured by a probe microphone or derived directly from audio channel signals |
| Temporal | Entropy | Entropy of one or more audio signals |
| Frequency spectrum-based | spCentroid | Spectral centroid of one or more audio signals |
| | spRolloff | Spectral rolloff of one or more audio signals |
| Binaural-based interaural cross correlation measures | iacc0 | Average of one or more octave band IACCs calculated at 0° and 180° head orientations |
| | iacc90 | Average of one or more octave band IACCs calculated at 90° and −90° head orientation |

TABLE 3-continued

| Type | Feature Name | Description |
|---|---|---|
| | Alternative versions IACC0 | The IACC calculated with the 0° head orientation. This value is computed as the mean IACC value across 22 frequency bands (150 Hz-10 kHz). |
| | IACC90 | The IACC calculated with the 90° head orientation. This value is computed as the mean IACC value across 22 frequency bands (150 Hz-10 kHz). |
| | IACC0 * IACC90 | The product of the IACC0 and IACC90 values above. |
| Source location-angle-based | Mean_Ang | The mean absolute change to the angles of a set of regularly spaced probe sound sources, distributed around the listening position, calculated using the directional localisation model. (Double-ended model only) |
| | Max_Ang | The maximum absolute change to the angles of a set of regularly spaced probe sound sources around the listening position, calculated using the directional localisation model. (Double-ended model only) |
| | Hull | Angles for each of a set of regularly spaced probe sound sources, distributed around the listening position, are calculated using the directional localisation model. These angles are then plotted on the circumference of a unit circle. The smallest polygon containing all these points (the convex hull) is determined. The final value of the metric is the area inside the convex hull. |

Prediction of Some Specific Auditory Space-Related Attributes

Sound Localisation From Binaural Signals by Probabilistic Formulation of hrtf-based Measurement Statistics In the following there is described a method according to the present invention for estimation of sound source direction based on binaural signals, the signals being received at the ears of a listener. Based on cues extracted from these signals, a method and corresponding system or device is developed according to the invention that employs a probabilistic representation of the cue statistics to determine the most likely direction of arrival.

Just as a camera determines the direction of objects from which light emanates, it is useful to find the direction of sound sources in a scene, which could be in a natural or artificial environment. In many cases, it is important to perform localisation in a way that mimics human performance, for instance so that the spatial impression of a musical recording or immersive sensation of a movie can be assessed. From the perspective of engineering solutions to directional localisation of sounds, perhaps the most widespread approach involves microphone arrays and the time differences on arrival of incident sound waves. According to a preferred embodiment of the present invention only two sensors are used (one to represent each ear of a human listener) and the prediction of the direction to a sound source does not rely only on time delay cues. It includes (but is not limited to) the use of both interaural time difference (ITD) and interaural level difference (ILD) cues. By enabling the responses of human listeners to be predicted, time-consuming and costly listening tests can be avoided. Many signals can be evaluated, having been processed by the system. Where acoustical simulations are manipulated in order to generate the binaural signals, it is possible to run extensive computer predictions and obtain results across an entire listening area. Such simulations could be performed for any given sound sources in any specified acoustical environment, including both natural sound scenes and those produced by sound reproduction systems in a controlled listening space.

There are possible applications of the invention at least in the following areas:

- Component in quality of service monitoring in broadcast control rooms, for example within the QESTRAL model where test signals have known locations and the system can be used to evaluate changes in the scene.
- Source localisation gauge in mixing desks.
- Source localisation gauge in sound design software applications.
- Aid for hearing impaired users that provides visual feedback on sound locations, either in reproduced sound or natural acoustical contexts (e.g., phantom, virtual or real sources).
- Automatic teleconferencing applications, such as diarisation.
- Object-based spatial sound codecs (as in MPEG4/7).

According to this embodiment of the invention there is provided a system, device and method for estimating the direction of a sound source from a pair of binaural signals, i.e. the sound pressures measured at the two ears of the listener. The listener could be a real person with microphones placed at the ears, an acoustical dummy or, more often, a virtual listener in a simulated sound field. The human brain relies on ITD and ILD cues to localise sounds, but its means of interpreting these cues to yield an estimated direction is not fully known. Many systems use a simple relation or a look-up table to convert from cues to an angle. According to the present invention this problem is considered within a Bayesian framework that guides the use of statistics from training examples to provide estimates of the posterior probability of an angle given a set of cues. In one embodiment, a discrete probability representation yields a set of re-weighted look up tables that produce more accurate information of how a human listener would perceive the sound direction. An alternative continuous probability embodiment might use, for example, a mixture of Gaussian probability density functions to approximate the distributions learnt from the training data.

Features of the Localisation Prediction According to the Invention

Compatibility

The localisation prediction according to the invention is compatible with any set of binaural signals for which the HRTF training examples are valid, or for any real or simulated sound field from which binaural signals are extracted. The current embodiment uses an HRTF database recorded with a KEMARK® dummy head, but future embodiments may use databases recorded with other artificial heads and torsos, properly averaged data from humans or personalized measurements from one individual. Where sufficient individual data are not available, the training statistics may be adapted to account for variations in factors such as the size of head, the shape of ear lobes and the position of the ears relative to the torso. By the principle of superposition, the training data may be used to examine the effects of multiple concurrent sources.

Probabilistic Formulation

Although the invention applies, in principle, to localisation of a sound source in 3D space, which implies the estimation of azimuth angle, angle of elevation, and range (distance to the sound source), for the sake of simplicity the following discussion will deal only with azimuth θ. The discussion here is also restricted to consideration of ITD and ILD cues, although the invention includes the use of other cues, such as timbral features, spectral notches, measures of correlation or coherence, and estimated signal-to-noise ratio for time-frequency regions of the binaural signals.

The Bayesian framework uses the statistics of the training examples to form probability estimates that lead to an estimate of the localisation angle $\hat{\theta}$ based on the cues at that time. To take one particular instantiation of the system, we will first consider an implementation that can form an approximation of the posterior probability of any angle θ given the ITD cue $\Delta_T$ and ILD cue $\Delta_L$. A more general case takes into account the dependency of the angle on both of these cues together, incorporating features of the joint distribution. However, the instantiation that we now describe combines the information by assuming independence of these cues: the product of their separate conditional probabilities is divided by the prior probability of the angle. Thus, the predicted or estimated source direction $\hat{\theta}$ is defined as the angle with the maximum probability:

$$\hat{\theta} = \underset{\theta}{\operatorname{argmax}}\, p(\theta|\Delta_T, \Delta_L)$$

$$p(\theta|\Delta_T, \Delta_L) = \frac{p(\theta|\Delta_T)p(\theta|\Delta_L)}{p(\theta)}$$

The prior probability p(θ) is a measure of how likely any particular source direction is to occur. In general, we may define all directions as equally likely by giving it a uniform distribution; in some applications however, there may be very strong priors on the audio modality, for instance, in television broadcast where the majority of sources coincide with people and objects shown on the screen in front of the listener.

The conditional probabilities for each cue are defined as:

$$p(\theta|\Delta_T) = \frac{p(\Delta_T|\theta)p(\theta)}{p(\Delta_T)} \quad p(\theta|\Delta_L) = \frac{p(\Delta_L|\theta)p(\theta)}{p(\Delta_L)}$$

where two normalizations are applied. Initial estimates of the probabilities may be gathered from counting the occurrences of interaural difference values at each angle. The first operation normalizes the training counts from recordings made at specified angles to give an estimate of the likelihood of a cue value given an angle p(Δ/θ), similar to the relative frequency. We refer to this as vertical normalisation as it applies to each column in the look-up table. The second operation, the horizontal normalisation applied to the rows, employs Bayes' theorem to convert the likelihood into a posterior probability, dividing by the evidence probability p(Δ). These steps are the same for ITD and ILD cues, $\Delta_T$ and $\Delta_L$, and are illustrated in FIG. 7*a* to 7*d*. A more detailed description of a particular procedure for forming a look-up table is furthermore found in APPENDIX 1 at the end of the detailed description.

One implementation of the process for training the system's representation of the posterior probabilities and thereby providing a prediction of the most likely azimuth angle to a sound source may be summarized as follows:

1. Select or adapt the training data to match most closely the ears used for capturing binaural signals in the chosen application.
2. Populate histograms using counts from the training data, and filling gaps in the histograms of observed cues by connecting consecutive data points and scaling proportionately.
3. Blur the counts at each azimuth by considering their variability (for example, by convolving the raw probability histogram with a Gaussian function with corresponding standard deviation), which tends to increase with frequency and with angular distance from straight ahead.
4. Vertical normalisation: ensure that the sum of likelihoods over each individual angle is one.
5. Horizontal normalisation: calculate the probability of the angle given the cue value, dividing the product of likelihood and the angle prior by the overall probability of that value (the evidence).

The trained look-up tables are then ready to be used in the chosen application with new unknown binaural signals for localisation. As shown in FIGS. 5, 6 and 7, the angular information coming from the ILD and ITD cues is combined into a single estimate of the angle probability.

Referring to FIGS. 5, 6 and 7 there is shown a schematic representation in the form of block diagrams illustrating a method according to the invention for predicting the source localisation based on binaural input signals L and R. These signals are initially passed through a filter bank 48, which may comprise filters of critical bandwidth covering part of or the entire audible frequency region. Filters of other bandwidths may also be used, if desired. The output signals from each filter is subsequently rectified and low pass filtered in block 49 after which the extraction of the localisation cues interaural time difference (ITD) and interaural level difference (ILD) (or interaural intensity difference, IID) takes place. For each individual filter band histograms of ITD and ILD indicated by block 50 and 51, respectively, have been provided (for instance based on measurements of ITD or IID at given, specific azimuth angles) and these histograms are used to predict (for each frequency band) the distribution of a corresponding azimuth angle given the particular ITD or IID as derived by blocks 57 and 62 (FIGS. 6 and 7), respectively. A calculation of loudness of each filter band is performed in block 52. Referring to FIG. 6 the formation of a histogram for IID is illustrated and referring to FIG. 7 the formation of ITD is illustrated, the two processes illustrated in FIGS. 6 and 7 being essentially identical.

Reverting to FIG. 5, once histograms of ITD and IIL have been formed they are weighted 53 (duplex theory weighting) in such a manner that the prediction in the low frequency bands is primarily based on the ITD histogram and at high frequencies on the ILD histogram. After suitable duplex theory weighting in block 53 the histograms are both (collectively) used to obtain the final prediction of azimuth (the source localisation output). A calculation of loudness of each critical band is performed in block 52 as mentioned above and utilised for a final loudness weighting 54. One purpose of this final loudness weighting 54 is to ensure that powerful frequency components actually play the most significant role in the overall prediction and it may even take psychoacoustic masking into account, so that frequency components (the output from given critical bands) that can probably not be perceived are not having a significant impact on predicted azimuth.

Referring to FIGS. 6 and 7 the basic steps for determining the histograms from IID and ITD, respectively, is shown. The two procedures, as illustrated in FIGS. 6 and 7, are basically identical and will hence be described collectively in the following. Determination of IID and ITD can be based on measured head related impulse responses (HRIR) for instance measured by means of an artificial head and after application of a suitable sample window 56, 61 the IID or ITD for each individual frequency band can be determined. These determined IIDs and ITDs are respectively compared with corresponding IID and ITD look-up tables 58 and 63 after which comparisons the histograms for each individual frequency band can be formed in blocks 59 and 64, respectively.

The formation of histograms is further illustrated with reference to FIGS. 8*a*, 8*b*, 8*c* and 8*d* that show: (a) the likelihoods of ITD values against the azimuth angle relative to the listener's head (in this case, of an acoustical dummy head), which were obtained from training data for filter-bank channel 12 and (b) with some smoothing applied. The process performs both vertical (c) and horizontal (d) normalizations of this table to produce estimates of the probability of an angle given the ITD. The grey tone level indicates the strength of the likelihood, with black being the highest. It is noted that although the range of azimuth values in the plots shown in FIGS. 8*a* through 8*d* is confined to −90 degrees to +90 degrees the principle according to the invention could be used over the entire horizontal plane, i.e. throughout the entire horizontal circle surrounding the listener/artificial head from −180 degrees to +180 degrees.

The procedure according to the invention for forming a histogram corresponding to a single, given frequency band is furthermore illustrated with reference to FIGS. 8*e* and 8*f*.

Referring to FIG. 8*e*, plot (a) shows—for a given frequency band—a distribution of ITD as a function on azimuth in the range 0 degrees (directly in front of a listener) to 90 degrees (directly to the right of the listener). The ITD is shown in arbitrary units in the figure. Corresponding to a given ITD ("30" as indicated in FIG. 8*e*(a)) there is a given distribution of azimuth (b) exhibiting for this ITD and this specific frequency band three sub-distributions d1, d2 and d3. To each of these sub-distributions there corresponds histograms h1, h2 and h3 as shown in FIG. 8*e*(c). As it appears from FIG. 8*e*(b) and (c) for a given ITD (or IID) and a given frequency band there may be multiple peaks in the histogram. However, as the histograms for the different frequency bands and different cues (ITD and IID) are combined, the peaks, where the cues matches, will generally be enhanced and the peaks where the cues do not match will generally be attenuated, thus overall leading to an unambiguous prediction of the azimuth. As for the plots shown in FIG. 8*a* through 8*d* the magnitude of the distribution is indicated by the grey tone value of the plot, black corresponding to the largest magnitude.

Figure 8F:
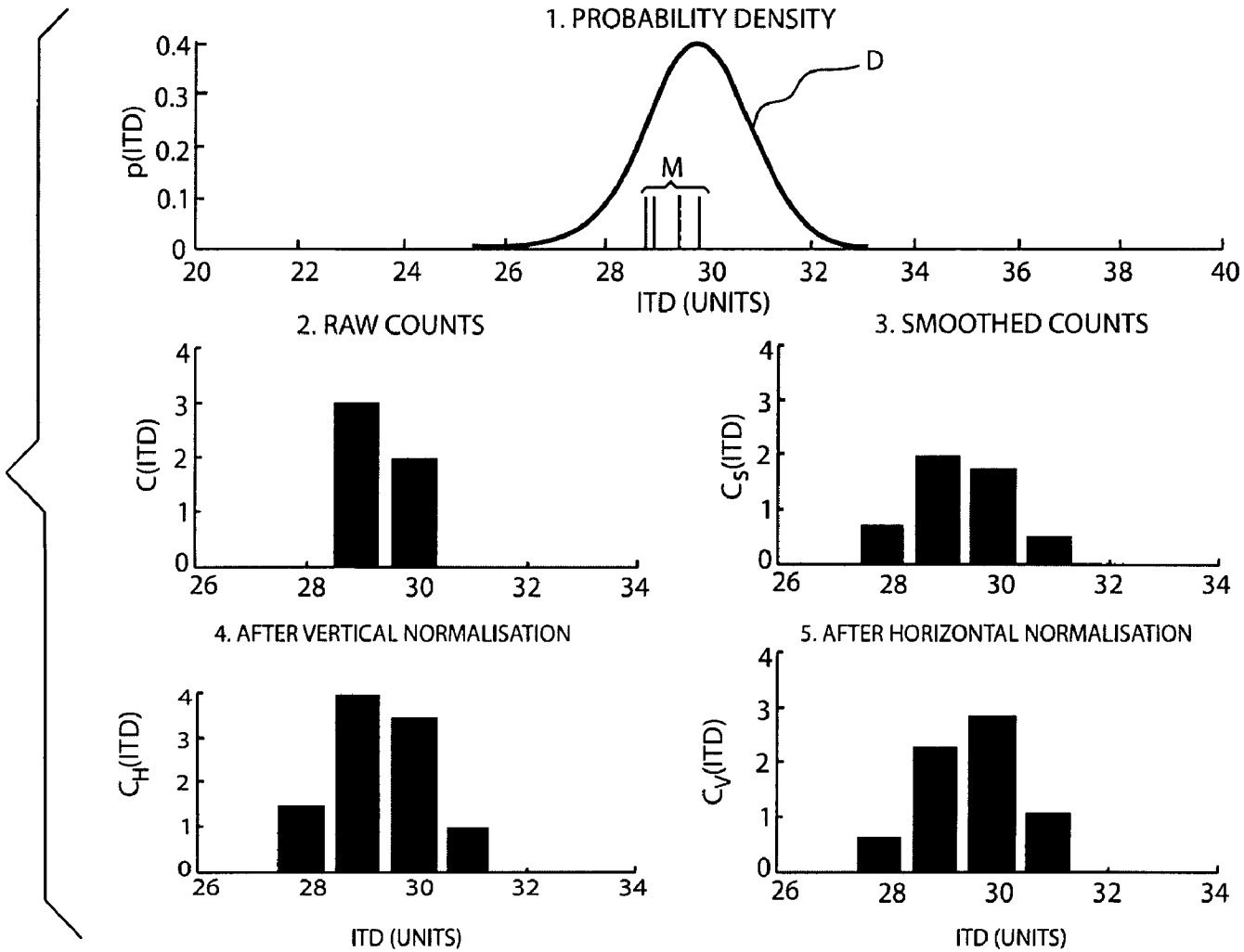

Referring to FIG. 8*f* there is shown a plot illustration the process according to the invention carried out on a set of hypothetical data for one column in the look-up table. Graph 1 of FIG. 8*f* shows a notional distribution D of ITDs that would be obtained from an infinite set of measurements, together with a set M of just five measurements drawn from the distribution D. These measurements are quantized and counted to produce the histogram of raw counts shown in graph 2 of FIG. 8*f*. The next step (graph 3 in FIG. 8*f*) smooths these raw counts in the ITD direction (equivalent to the vertical direction in the look-up table for instance shown in FIG. 8*e*(a)) using a suitable smoothing function. The purpose of the smoothing function is to achieve a probability density function (pdf) that is closer to the real pdf, based on very limited sample data, and incorporates some estimate of the measurement variability as well as knowledge of variability across the population in a frequency-dependent way. Basically its effect is to blur the few quantized measurements as an approximation of the estimated pdf. A Gaussian smoothing function may be applied, but the invention is not limited to this. The final stages show (graph 4 in FIG. 8*f*) "vertical" normalisation (over ITD), which ensures that the total area under the histogram sums to one, and (graph 5 in FIG. 8*f*) the "horizontal" normalisation which scan across the different azimuths to ensure that the area under the histograms sum to one in the azimuth-direction in the end.

A method for distinguishing between sound incidence from the frontal hemisphere and the rear hemisphere (i.e. for front/back disambiguation) is illustrated with reference to FIGS. 9*a* and *b*.

FIGS. 9*a* and *b* show plots of the estimated angular probability of source location for a given stationary source at −30 degrees for two head orientations: straight ahead and 5 degrees to the left. According to the invention in order to resolve front/back ambiguities two sets of binaural signals are passed sequentially through the localisation model according to the invention: one with the head at an orientation of θ and the other with an orientation of θ-□degrees (e.g. □equal to 5 degrees). I.e. the head is turned (rotated) 5 degrees to the left. The resulting angles are then compared and the direction in which the measured angle (provided by the model) moves is used to determine whether the signal is in front or in the back hemisphere. (Having measurements made at two or more head rotations is consistent with some of the other measures used in the model, in particular the IACC90, which uses a different set of binaural signals to the IACC0, i.e. a second set of measurements made at a different head rotation.

In the example shown in FIGS. 9*a* and *b* with a sound source S located in front of the head a rotation of the head to the left as shown will result in the angle from the localisation model moving to the right. Had the sound source been actually located at the back of the head as indicated by SI a corresponding head movement would have resulted in the angle from the model moving to the left. In the manner illustrated by this simple example it is possible to resolve front/back ambiguities even in more complex situations by one or a series of head movements.

FIG. 10. Illustration of the kind of user interface used by participants in listening tests to identify the locations of individual sound sources within a reproduced scene. A direction arrow can be added for each sound source separately identified using the "add direction arrow" button, and its angle can be altered by dragging the relevant arrow to represent the perceived angle of the source. Alternatively a numerical angle can be entered in one of the direction boxes, which changes the displayed angle of the relevant arrow. Once each source angle has been correctly identified, the location angle can be saved by pressing "save angle . . . " on the interface. "Play again" enables the source material to be repeated as many times as desired. Direction arrows can be removed individually using the "remove direction arrow" button.

The combination of information from each cue, across frequency bands and over time represents a form of multi-classifier fusion [Kittler, J. and Alkoot, F. M. (2003). "Sum versus vote fusion in multiple classifier systems", IEEE Transactions on Pattern Analysis and Machine Intelligence, Volume 25, Issue 1, Pages: 110-115]. To achieve optimal performance it is possible to extend the localisation based model beyond a series of naïve Bayes probability estimates. Essentially, as well as making the most likely interpretation of the measurements at any given moment, the system can consider whether these measurements are reliable or consistent. Loudness weighting performs a related operation, in that it gives more confidence to the measurements that are assumed to have a higher signal-to-noise ratio. Similarly, methods for combining information over subsequent time frames, such as averaging, or thresholding and averaging, may be employed. A measure of the confidence of the extracted cue can be used to influence the fusion of scores, so that the overall output of the system combines the widest range of reliable estimates.

Extraction of Cues

The ITD and ILD cues on which the localisation prediction according to the present invention relies are currently extracted using standard techniques, as for instance described in the PhD thesis of Ben Supper [University of Surrey, 2005]. Yet, because the same signal processing is applied to the training data as to the test signals during system operation, alternative techniques can be substituted without any further change to the system, devices and method according to the present invention.

Artificial Listener Capabilities

Prediction of spatial attributes can be performed for arbitrary test signals. There is no restriction of the nature or type of acoustical signal that can be processed by the proposed invention. It may include individual or multiple simultaneous sources.

The proposed prediction of direction may be applied to time-frequency elements or regions of time-frequency space (e.g., in spectrogram or Gabor representation). A straightforward example could implement this notion by identifying which critical frequency bands were to be included for a given time window (a block of samples). In one embodiment, the selection of bands for each frame could be based on a binary mask that was based on a local signal-to-noise ratio for the sound source of interest.

The localisation of sound sources can be applied for evaluation of foreground and background streams. Human perception of sound through the signals received at the ears is contingent on the interpretation of foreground and background objects, which are broadly determined by the focus of attention at any particular time. Although the present invention does not provide any means for the separation of sound streams into foreground and background, it may be used to predict the location of sources within them, which includes any type of pre-processing of the binaural signals aimed at separation of content into foreground and background streams.

Improved localisation and front-back disambiguation can as mentioned above be achieved by head movement The resolution of human sound localisation is typically most accurate directly in front of the listener, so the location of a stationary source may be refined by turning the face towards the direction of the sound. Equally, such a procedure can be used in the present invention. Another active listening technique from human behaviour that can be incorporated into the present invention is head movement aimed at distinguishing between localisation directions in front of and behind the listener. Owing to the availability of only two sensors, there exists a "cone of confusion" about the axis (the line between the two ears). Thus, for a sound source in the horizontal plane there would be solutions front and back. However, whereas the true direction of the source would stay fixed with respect to the environment (inertial reference), the image direction would move around and lack stability, allowing it to be discounted. The present invention can embody a similar behaviour, where predictions are gathered for multiple head orientations, and those hypotheses that remain consistently located are identified (while inconsistent ones can be suppressed).

Use of Subjective Training Data From Listening Tests

For individual stationary sound sources in an anechoic environment, the majority of systems make the assumption that the perceived direction of localisation matches the physical direction of the sound source subtended to the listener. However, it is well known that human listeners make mistakes and introduce variability in their responses. In some cases, bias is introduced, for example for a sound source being perceived as coming from a location slightly higher than its true elevation angle. For the purposes of azimuth estimation, the embodiment of the present invention assumes perfect alignment between physical and perceived azimuth to provide annotation of the training data. In other words, we assume that a sound source presented at 45° to the right is actually perceived as coming from that direction. More generally, however, the probabilistic approach to localisation allows for any annotation of the recordings used for training. Thus, labels based on listening test results could equally be used, for example, to train the system to recognize source elevation in terms of the perceived elevation angles. Another embodiment involves the use of labels for other perceived attributes in training, such as source width, distance, depth or focus. The result is presented in terms of equivalent probability distributions based on the cues from the binaural signals for the attribute whose labels were provided. In other words, where the perception of an alternative spatial attribute (such as width or distance) may depend on the cues that the system uses (which typically include but are not limited to ITDs and ILDs), training data can be used in a similar way to formulate a probabilitistic prediction of that alternative attribute. Therefore, the use of labels in a training procedure enables alternative versions of the system to output predicted attribute values for any given test signals. This approach produces outputs that are more reliable estimates of human responses because: (i) it uses binaural signal features, such as ITD and ILD cues, in a way that imitates the primary stages of human auditory processing, and (ii) it can be trained to model the pdf of listener responses based on actual attribute data, such as the set of localisation angles.

An innovative aspect of our listening test methodology that was used to elicit responses of spatial attributes, such as directional localisation and perceived source width, from subjects was the use of a graphical user interface. The interface allowed spatial attributes of the perceived sound field to be recorded in a spatial representation. The example shown in FIG. 5 demonstrates how the localisation of each sound source was represented by an arrow in a sound scene that included multiple sources. The benefit of this approach is that it allows for a direct conversion of listening test data from a listener's experience to the domain of the perceived angle, maintaining the spatial relations within the test environment and without the need for an arbitrary scale.

Integration of Components From Scene to Scale

Within the context of an overall system for predicting the perceived spatial quality of processed/reproduced sound, the present localisation prediction model constitutes a module that takes binaural signals as input and provides an estimate of the distribution of posterior probability over the possible localisation angles. Most directly, by picking the maximum probability, or the peak of the pdf, the module predicts the most likely direction of localisation. Hence, the localisation module according to the invention can be used in conjunction with a sound-scene simulation in order to predict the most-likely perceptual response throughout listening area.

The present implementation is designed for sound sources in an anechoic environment. Nonetheless, any processing aimed at enhancing direct sound in relation to indirect sound can be used to improve the performance of the system. Conversely, for cases where it is important to identify the directions of reflections, the localisation module may be applied to the indirect, reflected sound. By concentrating, for example, on a time window containing the early reflections, the locations of the dominant image sources can be estimated, which may prove valuable for interpreting the properties of the acoustical environment (e.g., for estimating wall positions).

As discussed above in the section on the use of subjective training data, alternative outputs from the system can be achieved through supervised training. Soundfield features obtained in this way can be used in an overall quality predictor.

The close relationship between perceived and physical source locations implies that the output from the prediction of direction localisation has a meaningful interpretation in terms of physical parameters. Many prediction schemes can only be treated as a black box, without the capability of drawing any inference from intermediate attributes. For instance, a system that used an artificial neural network or set of linear regressions or look-up tables to relate signal characteristics directly to a measurement of spatial audio quality would typically not provide any meaningful information concerning the layout of the spatial sound scene. In contrast, as a component of a spatial quality predictor, the present module gives a very direct interpretation of the soundfield in terms of the perceived angles of sound sources.

Prediction of Perceived Envelopment According to an Embodiment of the Present Invention As a specific example there is in the following described a so-called "ENVELOMETER", which is a device according to the present invention for measuring perceived envelopment of a surrounding sound field, for instance, but not limited to, a reproduced sound field for instance generated by a standard 5.1 surround sound set-up.

People are normally able to assess this subjectively in terms of "high", "low" or "medium" envelopment. However, there have been very few attempts to predict this psychoacoustical impression for reproduced sound systems using physical metrics, and none that are capable of working with a wide range of different types of programme material, with and without reverberation. The envelometer according to the present invention described in detail in the following makes it is possible to measure this perceptual phenomenon in an objective way.

Definition of Envelopment

Envelopment is a subjective attribute of audio quality that accounts for the enveloping nature of the sound. A sound is said to be enveloping if it "wraps around the listener".

Why is it Important to Measure Envelopment?

A need for listeners to feel enveloped (or surrounded) by a sound is a main driving force behind the introduction of surround sound. For example, a 5.1 channel format was introduced to movies by the film industry in order to increase the sense of realism since it allows one to reproduce sound effects "around the listener". Another example is related to sports broadcasts, which in the near future will allow the listener to experience the sound of a crowd coming from all directions and in this way will enhance a sense of immersion or involvement in sports event. Hence, one of the most important features of a high-quality surround sound system is the ability to reproduce the illusion of being enveloped by a sound. An Envelometer according to the present invention could be used as a tool to verify objectively how good or bad a given audio system is in terms of providing a listener with a sensation of envelopment.

The overall aim of the present invention is to develop a system, one or more devices and corresponding methods that could for instance comprise an algorithm for prediction of spatial audio quality. Since, as mentioned above, the envelopment is an important component (sub-attribute) of spatial audio quality, it is likely that the here proposed Envelometer, or metrics derived from it, will form an important part of the spatial quality prediction algorithm.

AN EMBODIMENT OF THE ENVELOMETER ACCORDING TO THE PRESENT INVENTION

A schematic representation of an envelometer according to an embodiment of the present invention specifically for measuring/predicting envelopment of a five-channel surround sound is presented in FIG. 11. It shows the idea of measuring the envelopment of 5-channel surround sound (as generated by the set-up shown schematically in FIG. 12) using a single-ended approach (this will be discussed in more detail later).

Compatibility

Although an envelometer according to the invention as shown in FIG. 11 was used specifically for prediction envelopment of 5-channel surround reproduction the envelometer according to the invention is intended to measure the envelopment of any current and future sound reproduction systems including, but not limited to:

- 2-channel stereo
- 5-channel surround (as standardised in ITU-R BS.775 Recommendation)
- 22.2-channel surround system
- Ambisonics
- Wavefield Synthesis system
- Binaural systems Single-Ended Approach The distinct feature of this implementation of the Envelometer is that it is a single-ended meter (also called "un-intrusive"), as opposed to the double-ended meters ("intrusive"). In a single-ended approach the envelometer 66 measures the envelopment 68 directly on the basis of the input signals 67 (see FIG. 11). The degree of envelopment may be measured on a scale between 0 (no envelopment) and 100 (maximum envelopment) as shown in FIG. 11 and referred to in more detail in following paragraphs. In the double-ended approach (which will be described in more detail in connection with FIG. 14), the measuring device has two types of inputs: reference inputs and evaluation inputs. The measured quantity is estimated on the basis of how much the measured signals are different compared to the reference signals. Consequently double-ended meters do not measure the absolute quantities but only the "difference" between the measured signal and the reference signal.

Single-ended meters are much more difficult to develop than double-ended meters due to the difficulty in obtaining unbiased calibration data from listening tests. According to the invention this bias can be reduced by calibrating the scale in the listening tests using two auditory anchors 71 and 72, respectively near the ends of the scale 70, as shown in FIG. 13. As shown in FIG. 13 a listener listens to a recording R1 and assesses the envelopment by means of a scale 70 comprising for instance a range from 0% to 100% envelopment. A listener can start the recording by pressing a button 73 (or icon on a screen) and stop it using button (icon) 74. The assessed envelopment can be provided by the listener for instance by positioning of the indicator bar 70' on the scale using an appropriately designed user interface. The next recording can be started using button (icon) 75. The listener may hear reproductions of the auditory anchors (anchor signals) by pressing buttons (icons) 71 and 72, respectively.

In contrast to the double-ended approach, the advantage of the single-ended approach is the ease of interfacing with current industrial applications. For example, a single-ended version of the Envelometer does not require generating or transmitting any reference signals prior to measurement. Hence, for example, it can be directly "plugged-in" to broadcast systems for the in-line monitoring of envelopment of the transmitted programme material. Also, it can be directly used at a consumer site to test how enveloping a reproduced sound is. For example, placement of 5 loudspeakers for reproduction of surround sound in a typical living room is a challenging task. The Envelometer may help to assess different loudspeaker set ups so that the optimum solution can be found.

Calibrating the Scale—Choosing the Auditory Anchors

The above approach of calibrating the scale is well known in the literature. However, novel aspects are at least that (1) the approach is according to the invention applied to the scaling of envelopment and (2) specific anchor signals have been devised for application with the invention.

The following recordings can be used as an Anchor A defining a high sensation of envelopment on the scale used in the listening tests:

- spatially uncorrelated applause recording reproduced by loudspeakers around the listener (the listener feels that he/she is surrounded by applauding crowd)
- spatially uncorrelated rain recording reproduced by loudspeakers around the listener (feels that the raindrops are all around)
- spatially uncorrelated speech "babble" reproduced by loudspeakers around the listener (talkers around the listener)
- spatially uncorrelated white noise reproduced by loudspeakers around the listener (it gives rise to rather unusual sensation of noise around the listener)
- spatially uncorrelated pink noise reproduced by loudspeakers around the listener (the impression is similar to the one described above but it's less intrusive).

The Anchor B used to define a low sensation of envelopment can be achieved by processed versions of the signals described above. For example, if these signals are first downmixed to mono and then reproduced by the front centre loudspeaker, this will give rise to a very low sensation of envelopment as the sound will be perceived only at the front of the listener.

Finding appropriate anchor recordings for subjective assessment of envelopment is not a trivial task, but a number of different signals may be used. However, according to a presently preferred embodiment there is used a spatially uncorrelated 5-channel applause recording to anchor the highly enveloping point on the scale (Anchor A) and a mono applause recording reproduced via the centre channel only to anchor the lowly enveloping sound (Anchor B). The advantage of using the applause recording instead of more analytical signals, such as uncorrelated noise, is that they are more ecologically valid and therefore some listeners reported that the applause signals are easier to compare with musical signals in terms of the envelopment compared to some artificial noise signals. In addition, the advantage of using ecologically valid signals such as the applause is that they are less intrusive and less fatiguing for the listeners if they are exposed to these sounds for a long period of time. From a mathematical point of view, the applause signals have similar properties to some artificial uncorrelated noise signals. It should be noted, however, that the present invention is not limited to the above signals, nor to any specific processing of these.

Double-Ended Approach

It is possible to adapt the envelometer to the double-ended mode of measurement, which is exemplified by the embodiment shown in FIG. 14. In this mode of operation there are two sets of signals fed to the envelometer. The first set of signals 77 contains the test or reference signals. The second set of signals 78 contains the altered signals taken from the output of the Device Under Test 76 and fed to one input $I_2$ of the envelometer 79. The other input $I_1$ of the envelopmenter 79 receives the test signals 77. In the double-ended mode, the envelometer estimates the difference between the test signals 77 and the altered version 78 of the test signals and on this basis the change in envelopment is estimated and provided by the envelopmeter 79 for instance on an appropriate scale 80.

Some preliminary tests with a double-ended version of the Envelometer have been carried out. The test signal consisted of 8 talkers surrounding the listeners at equal angles of 30 degrees (there were 8 loudspeakers around the listener). There were two versions of the tests signal: foreground and background. The first version (foreground) contained only the anechoic (dry) recordings of speech. The second version (background) contained only very reverberant counterparts of the above version.

The Envelopment Scale

Another novel approach of the proposed Envelometer is the scale used to display the measured envelopment. It is proposed to use a 100-point scale, where the two points on the scale, A and B (see figure pp) define the impression of the envelopment evoked by the high and low anchor signals, respectively, as for instance by said uncorrelated applause signals and by a mono down-mix of the applause signal reproduced by the front loudspeaker respectively.

It should be noted that there are several other possible scales that could be used both in the Envelometer and in the listening tests but the one proposed in FIG. 15 is presently preferred. Some other possible scales will be outlined below.

Other Possible Scales—Outline

Below are outlined three major approaches that could be chosen for both subjective and objective assessment of envelopment. There are many variants of all three methods and only typical examples are presented in TABLE 1 below.

TABLE 1

Types of scales that could be used to estimate a sensation of envelopment.

| | Example | Properties |
|---|---|---|
| Categorical Scale | "How enveloping are these recordings?"<br>5. Extremely enveloping<br>4. Very enveloping<br>3. Moderately enveloping | This scale is susceptible to strong contextual effects such as range equalising bias and centring bias. If a number of stimuli under assessment is small, |

TABLE 1-continued

Types of scales that could be used to estimate a sensation of envelopment.

| | Example | Properties |
|---|---|---|
| | 2. Slightly enveloping<br>1. Not enveloping | the results will be contraction bias.<br>Due to the ordinal nature of the scale, the data obtained in the listening test is inherently affected by a quantisation effect.<br>If this scale is used, the research indicates that it might not be possible to obtain any reliable data from the listening tests using a single-ended approach, that is when listeners make absolute and not comparative judgments. |
| Ratio Scale | "The envelopment of sound A is '1'. Listen to the sound B and if you feel that it is twice as much enveloping as sound A, use the number '2'. If you feel that it is three times more enveloping, use number '3' etc." | The advantage of this approach is that the scale is open-ended. It means that there would be no clipping or "ceiling" effect if extremely enveloping recordings were assessed (it is impossible to synthesise a stimulus that extends beyond the range of the scale).<br>However, the research shows that the data obtained using this scale is subject to a logarithmic bias. |
| Graphic Scale | "How enveloping is this sound? Indicate your answer by placing a mark on the line below." | The scale is continuous and therefore there is no quantisation effect. |
| | ● Extremely<br>●<br>●<br>● Not | The scale can be intuitive and easy to use<br>However, this scale is also susceptible to strong contextual effects such as range equalising bias and centring bias or a contraction bias, unless it is calibrated using auditory anchors.<br><br>If this scale is used, the research indicates that it might not be possible to obtain any reliable data from the listening tests using a single-ended approach, that is to say, when listeners make absolute judgments without comparison with reference sounds. |

The table above shows only some manifestations of the scales discussed. For example, the other possible manifestations of the categorical scale are the uni-dimensional scale and semantic differential scale presented in FIGS. 16 and 17.

Moreover, it is possible to use indirect scales for assessment of envelopment, for example the Likert scales, shown in FIG. 18.

Regardless of the type of the scale used (ordinal, ratio, graphic) the main challenge is to obtain un-biased envelopment data from a listening test that is going to be used to calibrate the Envelometer. If the data from the listening test is biased, the errors would propagate and would adversely affect the reliability and the precision of the meter. The task of obtaining unbiased data from a subjective test is not trivial and there are many several reports demonstrating how difficult it is. Currently, it seems that the only way of reducing biases, or at least keeping them constant, is to properly calibrate the scale using some carefully chosen auditory anchors as shown in TABLE 2 below:

TABLE 2

Different graphic scales and their properties.

| Graphic scales | Example | Type of calibration | Properties |
|---|---|---|---|
| Without labels | | Semantic | Listeners have lots of freedom in interpreting the scale The scale is not well calibrated and hence potentially prone to lots of contextual biases |
| Envelopment | | | |
| With labels at the ends only | | Semantic, based on the meaning of labels | The interpretation of the labels may very across the listening panel |
| Extremely enveloping<br>Not enveloping | | | Hence, a potential for bias Research shows that this scale is prone to lots of contextual biases |
| With intermediate labels | | Semantic, based on the meaning of labels | Although the impression is that the middle part of the scale is better defined, there is some experimental evidence that listeners use this scale similarly to the scale above Again, contextual biases |
| Extremely enveloping<br>Very enveloping<br>Enveloping<br>Slightly enveloping | | | |
| With two auditory anchors | | Auditory, based on the auditory properties of the auditory anchor sounds | The subjectivity factor due to different interpretation of verbal labels removed |
| Sound A<br>Sound B | | | The scale better calibrated using the auditory anchors Contextual biases greatly reduced |
| With intermediate auditory anchors | | Auditory, based on the auditory properties of the auditory anchor sounds | Similar as above Potentially greater precision along the scale |
| Sound A<br>Sound B<br>Sound C<br>Sound D<br>Sound E | | | However, it is might be difficult to select the auditory anchors that are perceptually uniformly spaced on the scale |

As already discussed above, in the listening tests that were performed and in the embodiment of an Envelometer according to the invention it was decided to use a graphic scale with the two auditory anchors, which provides the listeners with a fixed frame of reference for their assessment of envelopment and in this way reduces the contextual biases and stabilises the results. Similarly, if the results from the Envelometer are interpreted by their users, the frame of reference is clearly defined (points A and B on the scale) and hence the user will know how to interpret the results. For example, if the envelopment predicted by the Envelometer is approximately 80, it would mean that the sound is very enveloping. To be more specific, it is almost as enveloping as the sound of the applause surrounding a listener, which defines the point 85 on the scale (highly enveloping Anchor A).

If the auditory anchors were not used, the contextual effects would make it almost impossible to predict the envelopment of recording in different listening tests with a high precision. However, it might still be possible to predict correctly the rank order of different stimuli in terms of their envelopment.

Feature Extraction

An internal structure of the current version of the Envelometer (a prototype) is presented in FIG. 19. As can be seen, five loudspeaker signals 81 from the standardised five-channel set-up are fed directly to the feature extractor 83. In addition, the signals 81 are processed and fed indirectly to the extractor through. These signals are processed in the QESTRAL Encoder block 82. Currently, the following processes are used:

conversion to mono.

conversion to two-channel stereo in a binaural format.

Ambisonic format.

The envelometer estimates the envelopment of the surround sound based on physical features of the input signals including, but not limited to:

- inter-aural cross-correlation measures based on binaural signal obtained by convolving direct input signals with associated head related impulse responses (QESTRAL Encoder)
- the amount of explained variance associated with eigen-signals in a Karhunen-Loeve transform
- back-to-front energy ratio
- entropy level of binaural signals obtained by convolving direct input signals with associated head related impulse responses More examples are presented in TABLE 3 below.

TABLE 3

Features used in the Envelometer prototype.

| Type | Feature Name | Description |
|---|---|---|
| Based on Karhunen-Loeve Transform (KLT) | klt_var1 | Variance of the first eigen vector of KLT normalised to 100%. This is a measure of inter-channel correlation between loudspeaker signals. |
| | klt_centroid_n | Centroid of KLT variance. This is a measure of how many channels are active in the KLT domain. To account for a non-linear relationship between the perception of envelopment and the centroid, the raw feature data was transformed using a third-order polynomial. |
| | KLTAmax_Area90 | KLT was used to calculate how the dominant angle of sound incidence fluctuates in time. For mono sound sources the angle fluctuates around 0. For enveloping sources it may vary between ±180 degrees. The feature was calculated using the area of coverage. Area based on dominant angles (threshold = 0.90) |
| | KLTA_Cent_Hist90_n | Similar feature as above. Centroid of histogram plotted for dominant angles (threshold = 0.90). Raw data from this metric was non-linearly processed using a third-order polynomial to account for a non-linear relationship between the envelopment and the coverage angle. |
| Energy-based | BFR | Back-to-Front energy ratio |
| | LErms_n | Lateral energy. Raw data = was non-linearly processed using a third-order polynomial to account for a non-linear relationship between the envelopment and the coverage angle. |
| Frequency spectrum-based | spCentroid | Spectral centroid of mono down-mixed signal |
| | spRolloff | Spectral Rolloff of mono down-mixed signal |
| Binaural-based | iacc0 | Average of Octave band IACCs calculated at 0° and 180° head orientations |
| | iacc90 | Average of Octave band IACCs calculated at 90° and −90° head orientations |

There are some additional features that have not been identified as statistically significant in the presently preferred embodiment of the Envelometer according to the invention, but which may be of importance as they were identified as significant in preliminary experiments. They include features such as:

- entropy of the left channel in the binaural signals obtained by convolving the original 5-channel recordings with HRTFs
- interaction between iacc0 and iacc90
- total energy Prediction Once the features are extracted in the Envelometer, they are used as input signals for the predictor 84 (see FIG. 19). There are several ways in which the predictor could be designed. The examples include:

Look-up tables

Artificial Neural Networks.

Regression Models.

In present embodiment it was decided to use a linear regression model with the first order interactions between features, but it is understood that other models and also artificial neural networks might be used in connection with the present invention. The adopted model can be expressed using the following equation:

$$y=k_1x_1+k_2x_2+k_3x_3+\ldots+k_{12}x_1x_2+k_{13}x_1x_3+\ldots+g,$$

where $x_i$: the i-th feature $x_ix_j$: the term representing the interaction between the i-th and j-th features k: regression coefficients g: constant.

Calibration

In listening test carried out the participants assessed the envelopment of 181 audio recordings. They predominantly consisted of commercially released 5-channel surround sound recordings. In addition, two-channel stereo and one-channel mono recordings were also included in this database as they represented recordings of lower level of envelopment. Moreover, some of the recordings were deliberately degraded using typical processes used currently in modern audio systems. Examples of controlled degradations are presented in TABLE 4.

TABLE 4

Examples of controlled degradations applied to some of the recording used for calibration purposes.

| No. | Type | Process name | Algorithm |
|---|---|---|---|
| 1 | Reference | Ref | Unprocessed |
| 2 | AudX | AudX80 | Aud-X algorithm at 80 kbps |
| 3 | AudX | AudX192 | Aud-X algorithm 192 kbps |
| 4 | AAC Plus + MPS | AACPlus64 | Coding Technologies algorithm 64 kbps |
| 5 | Bandwidth limitation | BW3500 | L, R, C, LS, RS - 3.5 kHz |
| 6 | Bandwidth limitation | BW10K | L, R, C, LS, RS - 10 kHz |
| 7 | Bandwidth limitation | Hybrid C | L, R - 18.25 kHz; C - 3.5 kHz; LS, RS - 10 kHz |
| 8 | Bandwidth limitation | Hybrid D | L, R - 14.125 kHz; C - 3.5 kHz; LS, RS - 14.125 kHz |
| 9 | Down-mixing | DM3.0 | The content of the surround channels is down-mixed to the three front channels according to [ITU-R Recommendation BS. 775-1, 1994] |
| 10 | Down-mixing | DM2.0 | Down-mix to 2-channel stereo according to [ITU-R Recommendation BS. 775-1, 1994] |
| 11 | Down-mixing | DM1.0 | Down-mix to mono according to [ITU-R Recommendation BS. 775-1, 1994] |
| 12 | Down-mixing | DM1.2 | The content of the front left and right channels is down-mixed to the centre channel. The surround channels are kept intact. (according to [Zielinski et al, 2003]) |
| 13 | Down-mixing | DM3.1 | The content of the rear left and right channels were down-mixed and panned to LS and RS channels. The front channels were kept intact. |

With reference to FIG. 20 there is shown the results of the calibration. As it can be seen, the correlation between the scores obtained in the listening tests (measured) and the predicted scores by means of the envelometer was equal to 0.9. The average error of calibration was 8.4 points with respect to 100-point scale. The results can be considered to be satisfactory, especially in the context of a single-ended version of the meter (development of single-ended meters is much more challenging than that of double-ended).

TABLE 5 shows the regression coefficients used in the Envelometer after its calibration. The table contains both raw and weighted coefficients. The raw coefficients were used to generate the predicted data presented in previously discussed FIG. 20. The weighted coefficients can be used to assess which features are of the most important. For example, in the current version of the envelopment the three most important features are:

KLTAmax_Area90

KLTA_Cent_Hist90_n

Interaction between iacc0 and klt_centroid_n

TABLE 5

Regression coefficients obtained after calibrating the Envelometer.

| Type | Feature Name | Standardised Coefficient | Raw coefficient |
|---|---|---|---|
| Constant | — | 1.68 | 32.83 |
| Based on | klt_var1 | −0.075 | −0.0698 |
| Karhunen-Loeve | klt_centroid_n | 0.123 | 0.158 |
| Transform (KLT) | KLTAmax_Area90 | 0.153 | 2.566 |
| | KLTA_Cent_Hist90_n | 0.140 | 0.173 |
| Energy-based | BFR | 0.086 | 3.736 |
| | LErms_n | 0.110 | 0.150 |
| Frequency | spCentroid | 0.079 | 0.001694 |
| spectrum-based | spRolloff | 0.119 | 0.001043 |
| Binaural-based | iacc0 | −0.088 | −9.255 |
| | iacc90 | −0.112 | −13.917000 |

TABLE 5-continued

Regression coefficients obtained after calibrating the Envelometer.

| Type | Feature Name | Standardised Coefficient | Raw coefficient |
|---|---|---|---|
| Interaction 1 | klt_var1 * LErms_n | 0.106 | 1.684 |
| Interaction 2 | iacc0 * klt_centroid_n | 0.127 | 1.746 |

Validation

In the validation part of the development of the present embodiment of an envelometer according to the invention a separate database of subjective responses was used. This database was obtained using the same listeners as above but different programme material and different controlled degradation (but of the same nature). In total 65 recordings were used in the validation part of the development.

The results of the validation are presented in FIG. 21. It can be seen that the correlation between the predicted (Y-axis) and actual (X-axis) scores obtained in the listening tests is high and equals 0.9. The average discrepancy between the actual and predicted scores is equal to approximately 8 points relative to the 100-point scale employed in the listening test.

Potential Applications

- A sub-component of a new version of objective models for prediction of audio quality. Currently standardised models do not take into account any spatial features of audio, which makes them not applicable to 2-channel stereo or any of the surround sound formats. In order to extend the applicability of the current standards, the spatial characteristics of sound have to be taken into account. The developed Envelometer can play a major role here.
- Quality of service monitoring. For example, the envelometer could be used by broadcasters to monitor how enveloping broadcasted material is.
- An envelopment gauge in mixing desks. This device may assist the audio engineers during the mixing of their recordings and will provide some visual cues indicating how enveloping the programme material is, compared to some fixed reference recordings (anchors A and B).

An aid for selection of programme material for listening test. Typically, the selection of programme material is done "by ear". However, the experimenters are often accused of subjectivity and they may want to prove the correctness of their choices by some physical measures.

An envelopment gauge in sound design software applications (such as audio for games etc.)

Consumers—setting up the equipment in a lounge—cinemas, theatres etc. As mentioned before, placement of 5 loudspeakers for reproduction of surround sound in a typical living room is a challenging task. The Envelometer may help to assess different loudspeaker set ups so that the optimum solution can be found.

Finally, FIGS. 22 and 23 show examples of (F) distortions and direct and indirect envelopment.

Thus, FIG. 22 show circles that represent individually perceivable sound sources in a spatial audio scene. In the upper example (a) and (b), representing the likely effect of downmixing from multichannel surround to two-channel stereo, sources that were arranged in a circle around the listener in the original version (a) have been mapped onto an angle in front of the listener (b). In the lower example (c), (d) and (e), representing front image narrowing or skew, sources that were panned across a wide subtended angle (c) have been compressed into a narrower subtended angle (d) or skewed to the right and compressed (e).

FIG. 23 shows graphical representation of the concepts of direct and indirect envelopment.

The invention claimed is:

1. A method for single-ended (unintrusive) prediction of perceived spatial quality of sound processing and reproducing equipment, devices, systems or methods (abbreviated DUT (Device under test)), the method of prediction comprising the steps of:

providing a DUT, a spatial sound reproduction quality or reproduction of which is to be tested;

providing one of a test signal or a transcoded test signal, where the test signal is transcoded to a format appropriate for the DUT to thereby obtain the transcoded test signal;

providing said test signal or said transcoded test signal to said DUT;

measuring or recording one or more reproduced or processed signals from said DUT;

applying one or more metrics to said one or more reproduced or processed signals, where said one or more metrics is/are designed for providing a physical measure of either said spatial quality as a holistic quantity or for providing physical measures of specific auditory attributes related to said spatial quality;

during a calibration procedure establishing a relationship or correlation between said physical measure(s) and spatial quality assessments or ratings obtained from listening tests carried out on real listeners;

applying said relationship or correlation to the output from one or more of said metrics thereby to obtain a prediction of the perceived spatial quality (holistic or relating to specific spatial attributes) provided by said DUT.

2. A method according to claim 1, wherein said test signal is a 5 channel de-correlated pink noise signal.

3. A method according to claim 1, wherein said test signal is pink noise bursts, pair-wise constant power panned from 0° to 360° in 10° increments.

4. A method according to claim 1, wherein said test signal consists of 8 talkers surrounding a listener at equal angles of 30 degrees.

5. A method according to claim 1, wherein said test signal contains only anechoic (dry) recordings of speech.

6. A method according to claim 1, wherein said test signal contains only very reverberant counterparts of recordings of speech.

7. A method according to claim 1, wherein said test signal is created in a specific channel format corresponding to the format of the system under test.

8. A method according to claim 1, wherein said transcoding is the transcoding that is required in order to be able to use a test signal comprising a universal directional encoding.

9. A method according to claim 8, wherein said universal directional encoding is a high order spherical harmonics for driving a standard 5.1 surround sound loudspeaker set-up.

10. A method according to claim 1, wherein said metrics comprise a "hierarchy" of metrics, where low-level metrics are derived directly from raw data and higher-level metrics derive the final objective measure from a set of low-level metrics.

11. A method according to claim 1, wherein said relationship or correlation comprises look-up tables, artificial Neural Networks and regression models.

12. A method for double-ended (intrusive) prediction of perceived spatial quality of sound processing and reproducing equipment, devices, systems or methods (abbreviated DUT (Device under test)), the method of prediction comprising the steps of:

providing an equipment, device, system or method (DUT), a spatial sound reproduction quality or reproduction of which is to be tested;

providing one of a test signal or a transcoded test signal, where the test signal is transcoded to a format appropriate for the equipment, device, system or method (DUT) to thereby obtain the transcoded test signal;

providing said test signal or said transcoded test signal to said equipment, device, system or method (DUT);

measuring or recording one or more reproduced or processed signals from said equipment, device, system or method (DUT);

applying one or more metrics to said one or more reproduced or processed signals, where said one or more metrics is/are designed for providing a physical measure of either said spatial quality as a holistic quantity or for providing physical measures of specific auditory attributes related to said spatial quality, providing either the test or the transcoded test signal to a reference equipment, system, device or method;

measuring or recording one or more reproduced or processed signals from said reference equipment, device, system or method;

applying one or more metrics to said one or more reproduced or processed signals from the reference equipment, device, system or method, where said one or more metrics is/are designed for providing a physical measure of either said spatial quality as a holistic quantity or for providing physical measures of specific auditory attributes related to said spatial quality;

providing output signals from said metrics applied on said DUT and on said reference equipment, system, device or method, respectively;

carrying out a comparison or forming a difference between the outputs from the metrics from said DUT and said reference equipment, system, device or method, respectively, said comparison or difference forming a relative measure for predicting a difference between spatial attributes of the DUT and the reference equipment, system, device or method;

during a calibration procedure establishing a relationship or correlation between said relative measure and spatial quality ratings obtained from listening tests carried out on real listeners;

applying said relationship or correlation to the output of said comparison or difference, thereby to obtain a prediction of the perceived spatial quality difference (holistic or relating to specific spatial attributes) between said DUT and said reference equipment, system, device or method.

13. A method according to claim 12, wherein said test signal is a 5 channel de-correlated pink noise signal.

14. A method according to claim 12, wherein said test signal is pink noise bursts, pair-wise constant power panned from 0° to 360° in 10° increments.

15. A method according to claim 12, wherein said test signal consists of 8 talkers surrounding a listener at equal angles of 30 degrees.

16. A method according to claim 12, wherein said test signal contains only anechoic (dry) recordings of speech.

17. A method according to claim 12, wherein said test signal contains only very reverberant counterparts of recordings of speech.

18. A method according to claim 12, wherein said test signal is created in a specific channel format corresponding to the format of the system under test.

19. A method according to claim 12, wherein said transcoding is the transcoding that is required in order to be able to use a test signal comprising a universal directional encoding.

20. A method according to claim 19, wherein said universal directional encoding is a high order spherical harmonics for driving a standard 5.1 surround sound loudspeaker set-up.

21. A method according to claim 12, wherein said metrics comprise a "hierarchy" of metrics, where low-level metrics are derived directly from raw data and higher-level metrics derive the final objective measure from a set of low-level metrics.

22. A method according to claim 12, wherein said relationship or correlation comprises look-up tables, artificial Neural Networks and regression models.

* * * * *